US007303022B2

(12) United States Patent
Tilton et al.

(10) Patent No.: US 7,303,022 B2
(45) Date of Patent: Dec. 4, 2007

(54) WIRED CASING

(75) Inventors: Frederick T. Tilton, Spring, TX (US); David J. Brunnert, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 376 days.

(21) Appl. No.: 10/832,804

(22) Filed: Apr. 27, 2004

(65) Prior Publication Data

US 2004/0262013 A1 Dec. 30, 2004

Related U.S. Application Data

(63) Continuation-in-part of application No. 10/419,456, filed on Apr. 21, 2003, now abandoned, and a continuation-in-part of application No. 10/269,661, filed on Oct. 11, 2002, now Pat. No. 6,896,075.

(51) Int. Cl.
*E21B 19/08* (2006.01)

(52) U.S. Cl. ..... 166/380; 166/65.1; 166/242.1; 175/171

(58) Field of Classification Search ..... 166/380, 166/381, 65.1, 242.1, 242.6; 175/320, 322, 175/171; 340/853.7, 854.9, 855.2, 853.2
See application file for complete search history.

(56) References Cited

U.S. PATENT DOCUMENTS

| | | | |
|---|---|---|---|
| 122,514 | A | 1/1872 | Bullock |
| 761,518 | A | 5/1904 | Lykken |
| 1,077,772 | A | 11/1913 | Weathersby |
| 1,185,582 | A | 5/1916 | Bignell |
| 1,301,285 | A | 4/1919 | Leonard |
| 1,324,303 | A | 12/1919 | Carmichael |
| 1,342,424 | A | 6/1920 | Cotten |
| 1,418,766 | A | 6/1922 | Wilson |
| 1,459,990 | A | 6/1923 | Reed |
| 1,471,526 | A | 10/1923 | Pickin |
| 1,545,039 | A | 7/1925 | Deavers |
| 1,561,418 | A | 11/1925 | Duda |
| 1,569,729 | A | 1/1926 | Duda |
| 1,585,069 | A | 5/1926 | Youle |

(Continued)

FOREIGN PATENT DOCUMENTS

CA 2 335 192 11/2001

(Continued)

OTHER PUBLICATIONS

Alexander Sas-Jaworsky and J. G. Williams, Development of Composite Coiled Tubing For Oilfield Services, SPE 26536, Society of Petroleum Engineers, Inc., 1993.

(Continued)

*Primary Examiner*—Kenneth Thompson
*Assistant Examiner*—Daniel P Stephenson
(74) *Attorney, Agent, or Firm*—Patterson & Sheridan, LLP

(57) ABSTRACT

The present invention involves a method and apparatus for monitoring conditions downhole and/or manipulating downhole tools by placing electrical wire on a casing string while drilling with casing. Wire is inserted into a groove within the casing string while drilling with the casing string into a formation. The wire connects downhole equipment to surface equipment. Multiple casing strings may be drilled into the formation while wire is simultaneously inserted into a groove therein.

57 Claims, 9 Drawing Sheets

U.S. PATENT DOCUMENTS

| | | | |
|---|---|---|---|
| 1,597,212 | A | 8/1926 | Spengler |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,851,289 | A | 3/1932 | Owen |
| 1,880,218 | A | 10/1932 | Simmons |
| 1,917,135 | A | 7/1933 | Littell |
| 1,930,825 | A | 10/1933 | Raymond |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,102,555 | A | 12/1937 | Dyer |
| 2,105,885 | A | 1/1938 | Hinderliter |
| 2,167,338 | A | 7/1939 | Murcell |
| 2,214,226 | A | 9/1940 | English |
| 2,214,429 | A | 9/1940 | Miller |
| 2,216,226 | A | 10/1940 | Bumpous |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,344,120 | A | 3/1944 | Baker |
| 2,345,308 | A | 3/1944 | Wallace |
| 2,370,832 | A | 3/1945 | Baker |
| 2,379,800 | A | 7/1945 | Hare |
| 2,383,214 | A | 8/1945 | Prout |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Munsinger |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,696,367 | A | 12/1954 | Robishaw |
| 2,720,267 | A | 10/1955 | Brown |
| 2,738,011 | A | 3/1956 | Mabry |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,898,971 | A | 8/1959 | Hempel |
| 2,953,406 | A | 9/1960 | Young |
| 2,978,047 | A | 4/1961 | DeVaan |
| 3,001,585 | A | 9/1961 | Shiplet |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,195,646 | A | 7/1965 | Brown |
| 3,273,660 | A | 9/1966 | Jackson et al. |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,467,180 | A | 9/1969 | Pensotti |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,621,910 | A | 11/1971 | Sanford et al. |
| 3,624,760 | A | 11/1971 | Bodine |
| 3,635,105 | A | 1/1972 | Dickmann et al. |
| 3,656,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,712,376 | A | 1/1973 | Owen et al. |
| 3,729,057 | A | 4/1973 | Werner |
| 3,747,675 | A | 7/1973 | Brown |
| 3,748,330 | A | 7/1973 | Taciuk |
| 3,760,894 | A | 9/1973 | Pitifer |
| 3,776,307 | A | 12/1973 | Young |
| 3,776,320 | A | 12/1973 | Brown |
| 3,776,991 | A | 12/1973 | Marcus |
| 3,785,193 | A | 1/1974 | Kinley et al. |
| 3,808,916 | A | 5/1974 | Porter et al. |
| 3,818,734 | A | 6/1974 | Bateman |
| 3,838,613 | A | 10/1974 | Wilms |
| 3,840,128 | A | 10/1974 | Swoboda, Jr. et al. |
| 3,648,684 | A | 11/1974 | West |
| 3,857,450 | A | 12/1974 | Guier |
| 3,870,114 | A | 3/1975 | Pulk et al. |
| 3,881,375 | A | 5/1975 | Kelly |
| 3,885,679 | A | 5/1975 | Swoboda, Jr. et al. |
| 3,901,331 | A | 8/1975 | Djurovic |
| 3,911,707 | A | 10/1975 | Minakov et al. |
| 3,913,687 | A | 10/1975 | Gyongyosi et al. |
| 3,915,244 | A | 10/1975 | Brown |
| 3,934,660 | A | 1/1976 | Nelson |
| 3,935,910 | A | 2/1976 | Gaudy et al. |
| 3,945,444 | A | 3/1976 | Knudson |
| 3,947,009 | A | 3/1976 | Nelmark |
| 3,948,321 | A | 4/1976 | Owen et al. |
| 3,964,556 | A | 6/1976 | Gearhart et al. |
| 3,980,143 | A | 9/1976 | Swartz et al. |
| 4,049,066 | A | 9/1977 | Richey |
| 4,054,332 | A | 10/1977 | Bryan, Jr. |
| 4,054,426 | A | 10/1977 | White |
| 4,064,939 | A | 12/1977 | Marquis |

4,069,573 A 1/1978 Rogers, Jr. et al.
4,077,525 A 3/1978 Callegari et al.
4,082,144 A 4/1978 Marquis
4,083,405 A 4/1978 Shirley
4,085,808 A 4/1978 Kling
4,095,865 A 6/1978 Denison et al.
4,100,968 A 7/1978 Delano
4,100,981 A 7/1978 Chaffin
4,127,168 A 11/1978 Hanson et al.
4,127,927 A 12/1978 Hauk et al.
4,133,396 A 1/1979 Tschirky
4,142,739 A 3/1979 Billingsley
4,159,564 A 7/1979 Cooper, Jr.
4,173,457 A 11/1979 Smith
4,175,619 A 11/1979 Davis
4,182,423 A 1/1980 Ziebarth et al.
4,186,628 A 2/1980 Bonnice
4,189,185 A 2/1980 Kammerer, Jr. et al.
4,194,383 A 3/1980 Huzyak
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,288,082 A 9/1981 Setterberg, Jr.
4,311,195 A 1/1982 Mullins, II
4,315,553 A 2/1982 Stallings
4,319,393 A 3/1982 Pogonowski
4,320,915 A 3/1982 Abbott et al.
4,324,407 A 4/1982 Upham et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,429,620 A 2/1984 Burkhardt et al.
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,469,174 A 9/1984 Freeman
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,531,581 A 7/1985 Pringle et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,588,030 A 5/1986 Blizzard
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,610,320 A 9/1986 Beakley
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,697,640 A 10/1987 Szarka
4,699,224 A 10/1987 Burton
4,708,202 A 11/1987 Sukup et al.
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,770,259 A 9/1988 Jansson
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,858,705 A 8/1989 Thiery
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse 4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,024,273 A 6/1991 Coone et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,083,608 A 1/1992 Abdrakhmanov et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
6,374,506 B1 4/1993 Clay
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,303,772 A 4/1994 George et al.
5,305,830 A 4/1994 Wittrisch
5,305,839 A 4/1994 Kalsi et al.
5,311,952 A 5/1994 Eddison et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,343,968 A 9/1994 Glowka
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A * 3/1995 Lenze ..... 166/105
5,402,856 A 4/1995 Warren et al.
5,409,059 A 4/1995 McHardy
5,433,279 A 7/1995 Tassari et al.
5,435,386 A 7/1995 LaFleur
5,435,400 A 7/1995 Smith
5,452,923 A 9/1995 Smith
5,456,317 A 10/1995 Hood, III et al.
5,458,209 A 10/1995 Hayes et al.
5,461,905 A 10/1995 Penisson
5,462,120 A 10/1995 Gondouin
5,472,057 A * 12/1995 Winfree ..... 175/57
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A * 8/1996 Pringle et al. ..... 166/65.1
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,426 A 10/1996 Trahan et al.
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,611,397 A 3/1997 Wood
5,613,567 A 3/1997 Hudson
5,615,747 A 4/1997 Vail, III
2,741,907 A 6/1997 Genender et al.
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,685,369 A 11/1997 Ellis et al.
5,685,373 A 11/1997 Collins et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,718,288 A 2/1998 Bertet et al.
5,720,356 A 2/1998 Gardes
5,730,221 A 3/1998 Longbottom et al.
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.

5,746,276 A 5/1998 Stuart
5,755,299 A 5/1998 Langford, Jr. et al.
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,791,416 A 8/1998 White et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,829,539 A 11/1998 Newton et al.
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,540 A 4/1999 Pia et al.
5,890,549 A 4/1999 Sprehe
5,894,897 A 4/1999 Vail, III
5,901,787 A 5/1999 Boyle
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,021,850 A 2/2000 Wood et al.
6,024,169 A 2/2000 Haugen
6,026,911 A 2/2000 Angle et al.
6,029,748 A 2/2000 Forsyth et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,085,838 A 7/2000 Vercaemer et al.
6,089,323 A 7/2000 Newman et al.
6,098,717 A 8/2000 Bailey et al.
6,106,200 A 8/2000 Mocivnik et al.
6,119,772 A 9/2000 Pruet
6,131,664 A * 10/2000 Sonnier ..... 166/381
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,224,112 B1 5/2001 Eriksen et al.
6,227,587 B1 5/2001 Terral
6,234,257 B1 5/2001 Ciglenec et al.
6,237,684 B1 5/2001 Bouligny, Jr. et al.
6,244,363 B1 6/2001 McLeod
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,401,820 B1 6/2002 Kirk et al.
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,425,444 B1 7/2002 Metcalfe et al.
6,427,776 B1 8/2002 Hoffman et al.
6,429,784 B1 * 8/2002 Beique et al. ..... 340/853.2
6,431,626 B1 8/2002 Bouligny
6,433,241 B2 8/2002 Juhasz et al.
6,443,241 B1 9/2002 Juhasz et al.
6,443,247 B1 9/2002 Wardley
6,446,323 B1 9/2002 Metcalfe et al.
6,446,723 B1 9/2002 Ramons et al.
6,457,532 B1 10/2002 Simpson
6,458,471 B2 10/2002 Lovato et al.

6,464,004 B1 10/2002 Crawford et al.
6,464,011 B2 10/2002 Tubel
6,484,818 B2 11/2002 Alft et al.
6,497,280 B2 12/2002 Beck et al.
6,497,289 B1 12/2002 Cook et al.
6,527,047 B1 3/2003 Pietras
6,527,049 B2 3/2003 Metcalfe et al.
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Metcalfe et al.
6,547,017 B1 4/2003 Vail, III
6,553,825 B1 4/2003 Boyd
6,554,063 B2 4/2003 Ohmer
6,554,064 B1 4/2003 Restarick et al.
6,571,868 B2 6/2003 Victor
6,578,630 B2 6/2003 Simpson et al.
6,585,040 B2 7/2003 Hanton et al.
6,591,471 B1 7/2003 Hollingsworth et al.
6,591,905 B2 7/2003 Coon
6,595,288 B2 7/2003 Mosing et al.
6,612,383 B2 9/2003 Desai et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,640,903 B1 11/2003 Cook et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,029 B2 3/2004 Metcalfe et al.
6,702,040 B1 3/2004 Sensenig
6,705,413 B1 3/2004 Tessari
6,708,769 B2 3/2004 Haugen et al.
6,715,430 B2 4/2004 Choi et al.
6,719,071 B1 4/2004 Moyes
6,722,559 B1 4/2004 Millar et al.
6,725,917 B2 4/2004 Metcalfe
6,725,919 B2 4/2004 Cook et al.
6,725,924 B2 4/2004 Davidson et al.
6,725,938 B1 4/2004 Pietras
6,732,822 B2 5/2004 Slack et al.
6,742,584 B1 6/2004 Appleton
6,742,591 B2 6/2004 Metcalfe
6,742,596 B2 6/2004 Haugen
6,742,606 B2 6/2004 Metcalfe et al.
6,745,834 B2 6/2004 Davis et al.
6,749,026 B2 6/2004 Smith et al.
6,752,211 B2 6/2004 Dewey et al.
6,758,278 B2 7/2004 Cook et al.
6,802,374 B2 10/2004 Edgar et al.
6,832,658 B2 12/2004 Keast
6,837,313 B2 1/2005 Hosie et al.
6,840,322 B2 1/2005 Haynes
6,845,820 B1 1/2005 Hebert et al.
6,848,517 B2 2/2005 Wardley
6,854,533 B2 2/2005 Galloway
6,857,486 B2 2/2005 Chitwood et al.
6,857,487 B2 2/2005 Galloway et al.
6,866,306 B2 * 3/2005 Boyle et al. ..... 285/333
6,892,819 B2 5/2005 Cook et al.
6,920,932 B2 7/2005 Zimmerman
6,923,255 B2 8/2005 Lee
6,926,126 B2 8/2005 Baumann et al.
6,941,652 B2 9/2005 Echols et al.
6,953,096 B2 10/2005 Gledhill et al.
7,004,264 B2 2/2006 Simpson et al.
7,013,992 B2 3/2006 Tessari et al.
7,013,997 B2 3/2006 Vail, III
7,036,610 B1 5/2006 Vail, III
7,040,420 B2 5/2006 Vail, III
7,044,241 B2 5/2006 Angman
7,048,050 B2 5/2006 Vail, III et al.
7,082,997 B2 8/2006 Slack
7,090,004 B2 8/2006 Warren et al.
7,093,675 B2 8/2006 Pia
7,096,982 B2 8/2006 McKay et al.
7,100,710 B2 9/2006 Vail, III
7,100,713 B2 9/2006 Tulloch
7,108,072 B2 9/2006 Cook et al.
7,108,080 B2 9/2006 Tessari et al.
7,108,083 B2 9/2006 Simonds et al.
7,108,084 B2 9/2006 Vail, III
7,117,957 B2 10/2006 Metcalfe et al.
7,124,825 B2 10/2006 Slack
7,128,154 B2 10/2006 Giroux et al.
7,137,454 B2 11/2006 Pietras
7,140,443 B2 11/2006 Beierbach et al.
7,140,455 B2 11/2006 Walter et al.
7,143,847 B2 12/2006 Pia
7,147,068 B2 12/2006 Vail, III
7,159,668 B2 1/2007 Herrera
7,165,634 B2 1/2007 Vail, III
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0045284 A1 11/2001 Simpson et al.
2001/0047883 A1 12/2001 Hanton et al.
2002/0040787 A1 4/2002 Cook et al.
2002/0066556 A1 6/2002 Goode et al.
2002/0074127 A1 6/2002 Birckhead et al.
2002/0074132 A1 6/2002 Juhasz et al.
2002/0079102 A1 6/2002 Dewey et al.
2002/0108748 A1 8/2002 Keyes
2002/0134555 A1 9/2002 Allen et al.
2002/0145281 A1 10/2002 Metcalfe et al.
2002/0157829 A1 10/2002 Davis et al.
2002/0162690 A1 11/2002 Hanton et al.
2002/0166668 A1 11/2002 Metcalfe et al.
2002/0170720 A1 11/2002 Haugen
2002/0189806 A1 12/2002 Davidson et al.
2002/0189863 A1 12/2002 Wardley
2003/0029641 A1 2/2003 Meehan
2003/0034177 A1 2/2003 Chitwood et al.
2003/0042022 A1 3/2003 Lauritzen et al.
2003/0056947 A1 3/2003 Cameron
2003/0056991 A1 3/2003 Hahn et al.
2003/0070841 A1 4/2003 Merecka et al.
2003/0070842 A1 4/2003 Bailey et al.
2003/0111267 A1 6/2003 Pia
2003/0146023 A1 8/2003 Pia
2003/0164250 A1 9/2003 Wardley
2003/0164251 A1 9/2003 Tulloch
2003/0164276 A1 9/2003 Snider et al.
2003/0173073 A1 9/2003 Snider et al.
2003/0173090 A1 9/2003 Cook et al.
2003/0183424 A1 10/2003 Tulloch
2003/0213598 A1 11/2003 Hughes
2003/0217865 A1 11/2003 Simpson et al.
2003/0221519 A1 12/2003 Haugen
2004/0000405 A1 1/2004 Fournier, Jr. et al.
2004/0003490 A1 1/2004 Shahin et al.

| | | | |
|---|---|---|---|
| 2004/0003944 | A1 | 1/2004 | Vincent et al. |
| 2004/0011534 | A1 | 1/2004 | Simonds et al. |
| 2004/0011566 | A1 | 1/2004 | Lee |
| 2004/0016575 | A1 | 1/2004 | Shahin et al. |
| 2004/0060697 | A1 | 4/2004 | Tilton et al. |
| 2004/0060700 | A1 | 4/2004 | Vert et al. |
| 2004/0069500 | A1 | 4/2004 | Haugen |
| 2004/0069501 | A1 | 4/2004 | Haugen et al. |
| 2004/0079533 | A1 | 4/2004 | Buytaert et al. |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0112693 | A1 | 6/2004 | Baumann et al. |
| 2004/0118613 | A1 | 6/2004 | Vail |
| 2004/0118614 | A1 | 6/2004 | Galloway et al. |
| 2003/0141111 | A1 | 7/2004 | Pia |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0182579 | A1 | 9/2004 | Steele et al. |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0238218 | A1 | 12/2004 | Runla et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0011643 | A1 | 1/2005 | Slack et al. |
| 2005/0077048 | A1 | 4/2005 | Hall |
| 2005/0096846 | A1 | 5/2005 | Koithan et al. |
| 2005/0152749 | A1 | 7/2005 | Anres et al. |
| 2005/0183892 | A1 | 8/2005 | Oldham et al. |

FOREIGN PATENT DOCUMENTS

| | | |
|---|---|---|
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 397 323 | 11/1990 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| GB | 540 027 | 10/1941 |
| GB | 709 365 | 5/1954 |
| GB | 716 761 | 10/1954 |
| GB | 733596 | 7/1955 |
| GB | 7 928 86 | 4/1958 |
| GB | 8 388 33 | 6/1960 |
| GB | 881 358 | 11/1961 |
| GB | 887150 | 1/1962 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 221 482 | 2/1990 |
| GB | 2 223 253 | 4/1990 |
| GB | 2 224 481 | 9/1990 |
| GB | 2 239 918 | 7/1991 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 320 734 | 7/1998 |
| GB | 2 324 108 | 10/1998 |
| GB | 2 326 896 | 1/1999 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| GB | 2 396 375 | 6/2004 |
| GB | 2 397 314 | 7/2004 |
| RU | 1304470 | 1/1995 |
| RU | 2 079 633 | 5/1997 |
| RU | 2079633 | 5/1997 |
| WO | WO 82/01211 | 4/1982 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/01651 | 1/1998 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/18328 | 4/1999 |
| WO | WO 99/23354 | 5/1999 |

| | | |
|---|---|---|
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/37772 | 6/2000 |
| WO | WO 00/37773 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/50732 | 8/2000 |
| WO | WO 00/66879 | 11/2000 |
| WO | WO 00/77431 | 12/2000 |
| WO | WO 01/12946 | 2/2001 |
| WO | WO 01/46550 | 6/2001 |
| WO | WO 01/60545 | 8/2001 |
| WO | WO 01/66901 | 9/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/29199 | 4/2002 |
| WO | WO 02/44601 | 6/2002 |
| WO | WO 02/081863 | 10/2002 |
| WO | WO 02/086287 | 10/2002 |
| WO | WO 02/092956 | 11/2002 |
| WO | WO 03/006790 | 1/2003 |
| WO | WO 03/074836 | 9/2003 |
| WO | WO 03/087525 | 10/2003 |
| WO | WO 2004/022903 | 3/2004 |

OTHER PUBLICATIONS

A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utilizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars; Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properities, IBP 27500, Brazilian Petroleum Institute—IBP, 2000.
Coiled Tubing Handbook, World Oil, Gulf Publishing Company, 1993.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Drilling are Options" Drilling Contractor, Jan./Feb. 2002, pp. 52.
M. Gelfgat, "Retractable Bits Development and Application" Transactions of the ASME, vol. 120, Jun. 1998, pp. 124-130.
"First Success with Casing-Drilling" Word Oil, Feb. 1999, pp. 25.
Dean E. Gaddy, Editor, "Russia Shares Technical Know-How with U.S." Oil & Gas Journal, Mar. 1999, pp. 51-52 and 54-56.
U.S. Appl. No. 10/794,800, filed Mar. 5, 2004.
U.S. Appl. No. 10/832,804, filed Apr. 27, 2004.
U.S. Appl. No. 10/795,214, filed Mar. 5, 2004.
U.S. Appl. No. 10/794,795, filed Mar. 5, 2004.
U.S. Appl. No. 10/775,048, filed Feb. 9, 2004.
U.S. Appl. No. 10/772,217, filed Feb. 2, 2004.
U.S. Appl. No. 10/788,976, filed Feb. 27, 2004.
U.S. Appl. No. 10/794,797, filed Mar. 5, 2004.
U.S. Appl. No. 10/767,322, filed Jan. 29, 2004.
U.S. Appl. No. 10/795,129, filed Mar. 5, 2004.
U.S. Appl. No. 10/794,790, filed Mar. 5, 2004.
U.S. Appl. No. 10/162,302, filed Jun. 4, 2004.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
U.S. Appl. No. 10/618,093.
U.S. Appl. No. 10/189,570.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.

Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Tips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
U.K. Search Report, Application No. GB0408851.4, dated Aug. 18, 2004.
U.S. Appl. No. 10/259,214, filed Sep. 27, 2002, entitled "Smart Cementing Systems," Tilton et al.
GB Search Report, Application No. GB0408851.4, Dated Sep. 14, 2006.
Multilateral Case History, Onshore-Nigeria, Baker Hughes, 2000.
Multilateral Case History, Offshore Norway, Baker Hughes, 1995.
Tommy Warren, Bruce Houtchens, and Garrett Madell, Directional Drilling With Casing, SPE/IADC 79914, SPE/IADC Drilling Conference, Amsterdam, The Netherlands, Feb. 19-21, 2003, pp. 1-10.
GB Search Report, Application No. GB 0620747.6, dated Feb. 5, 2007.

* cited by examiner

Fig. 1
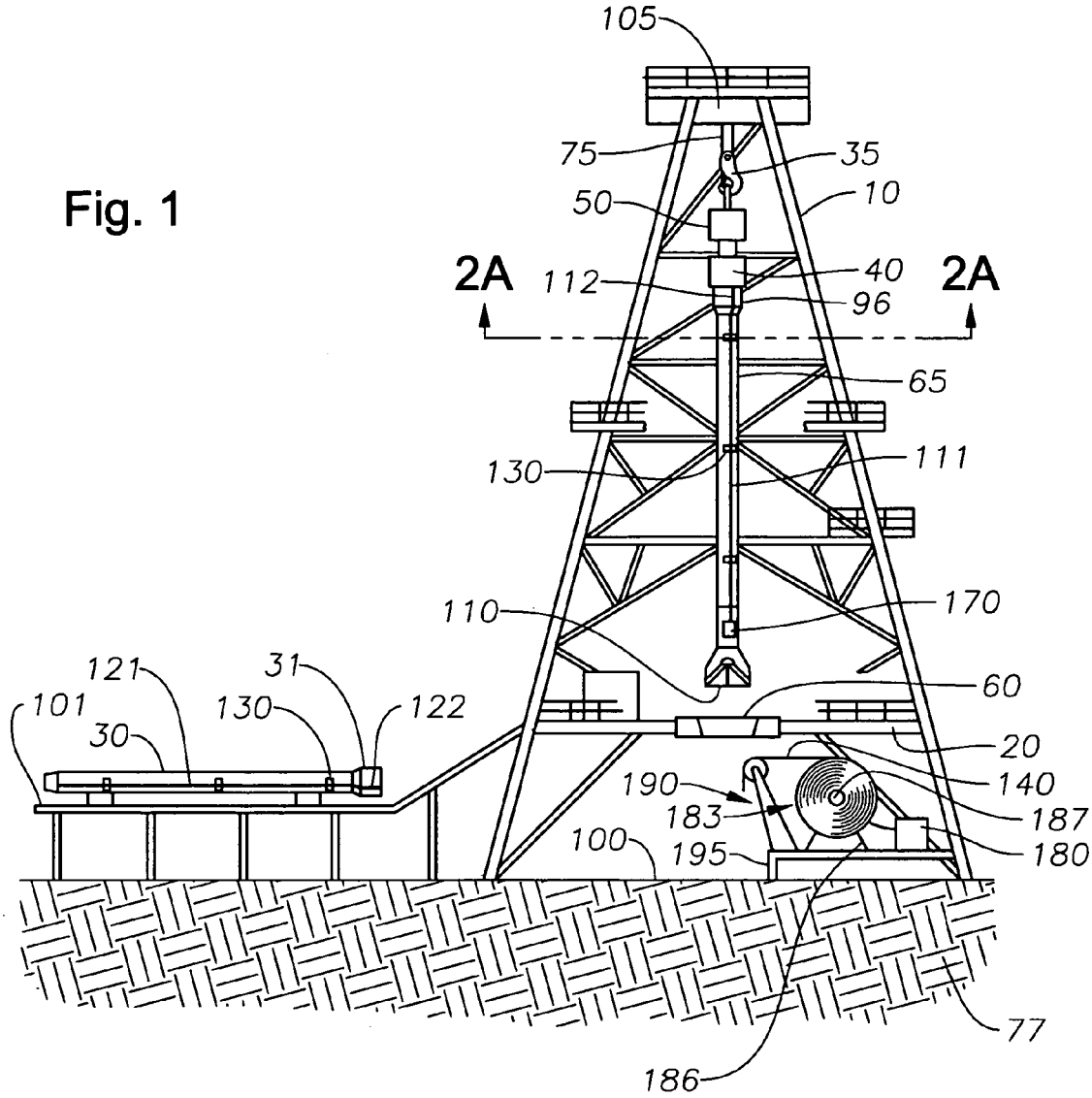
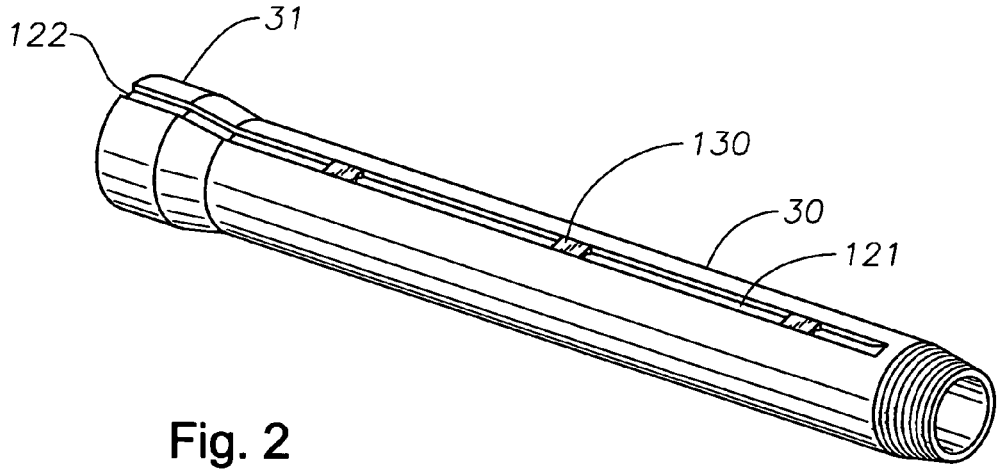
Fig. 2

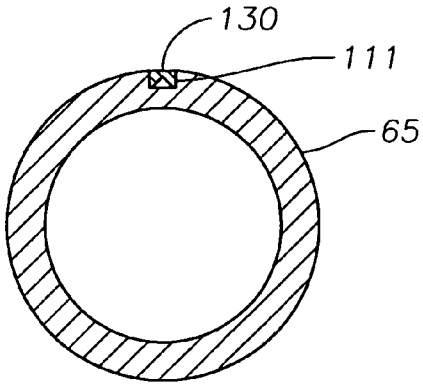
Fig. 2A
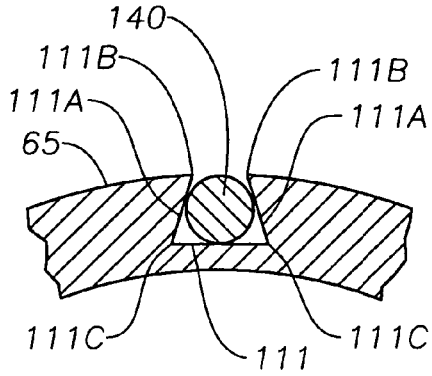
Fig. 2B
Fig. 3
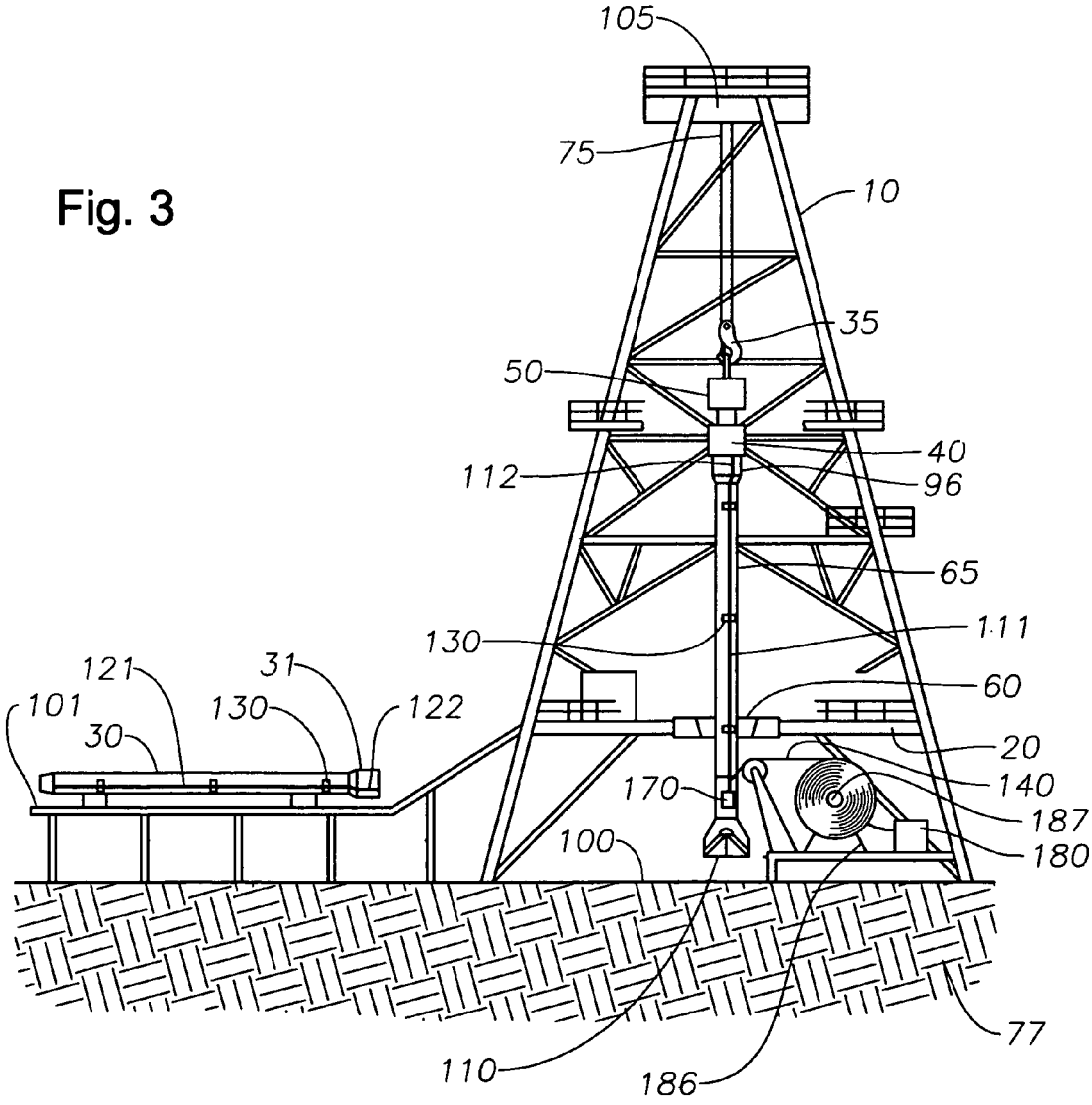

Fig. 11
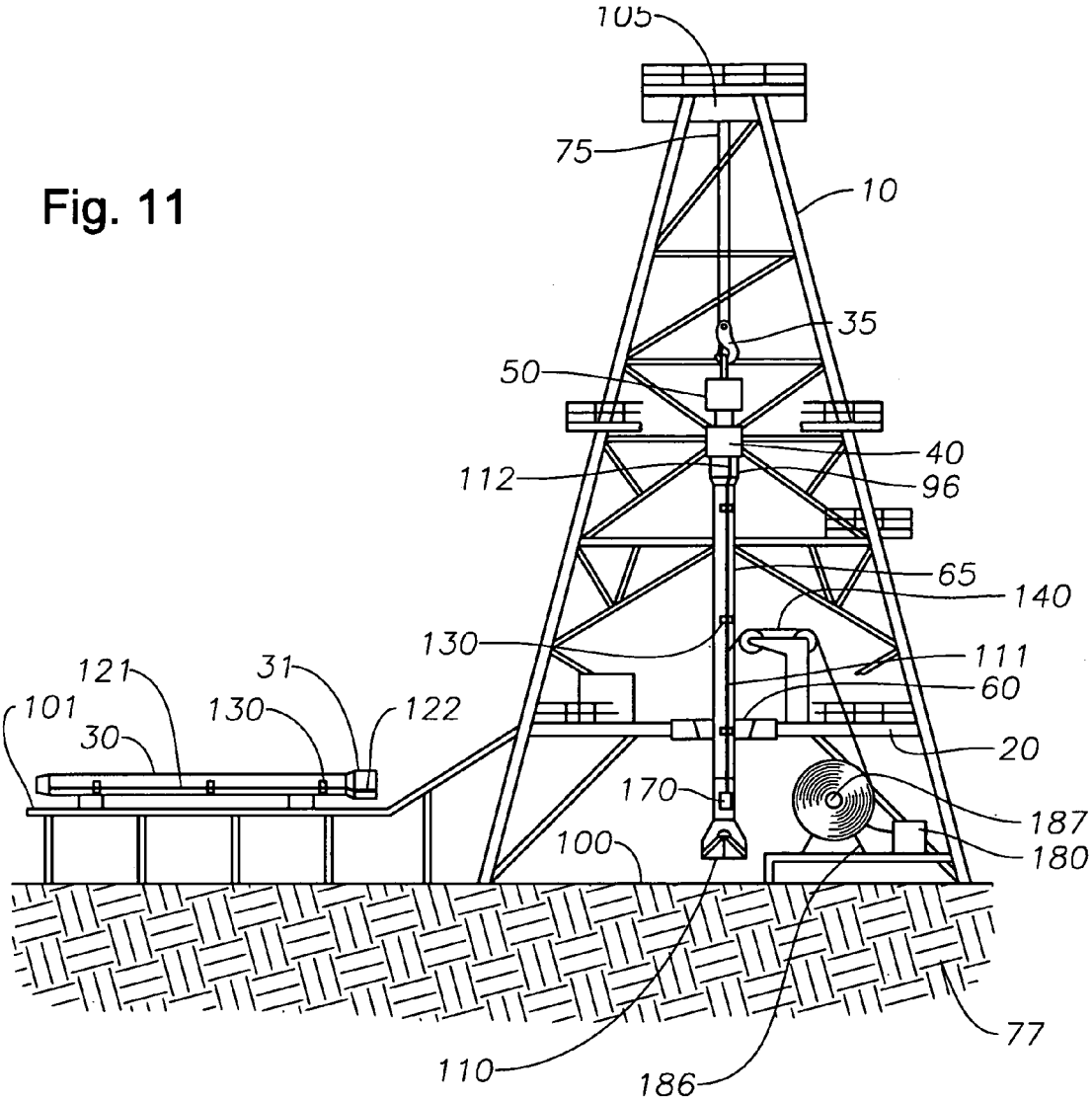
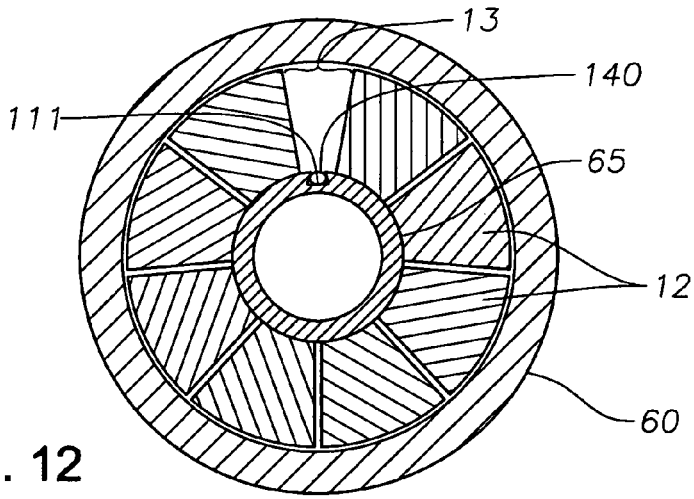
Fig. 12

WIRED CASING

CROSS-REFERENCE TO RELATED APPLICATIONS

This application is a continuation-in-part of U.S. patent application Ser. No. 10/419,456 filed Apr. 21, 2003, now abandoned which is herein incorporated by reference in its entirety. This application is also a continuation-in-part of U.S. patent application Ser. No. 10/269,661 filed Oct. 11, 2002 now U.S. Pat. No. 6,896,075.

BACKGROUND OF THE INVENTION

1. Field of the Invention

The present invention generally relates to a method and apparatus for monitoring conditions downhole and/or manipulating downhole tools. More particularly, the present invention relates to a method and apparatus for monitoring conditions downhole and/or manipulating downhole tools while placing wire which connects the surface to downhole onto a casing string while drilling with casing. Even more particularly, the present invention relates to a method and apparatus for wiring casing while drilling with casing.

2. Description of the Related Art

In conventional well completion operations, a wellbore is formed to access hydrocarbon-bearing formations by the use of drilling. In drilling operations, a drilling rig is supported by the subterranean formation. A rig floor of the drilling rig is the surface from which casing strings, cutting structures, and other supplies are lowered to form a subterranean wellbore lined with casing. A hole is formed in a portion of the rig floor above the desired location of the wellbore. The axis that runs through the center of the hole formed in the rig floor is well center.

Drilling is accomplished by utilizing a drill bit that is mounted on the end of a drill support member, commonly known as a drill string. The drill string includes sections of drill pipe threadedly connected to one another, often connected at the drilling rig by a pipe handling operation. To drill within the wellbore to a predetermined depth, the drill string is often rotated by a top drive or rotary table on the drilling rig. After drilling to a predetermined depth, the drill string and drill bit are removed and a section of casing is lowered into the wellbore.

Often, it is necessary to conduct a pipe handling operation to connect sections of casing to form a casing string which extends to the drilled depth. Pipe handling operations require the connection of a first casing section to a second casing section to line the wellbore with casing. To threadedly connect the casing strings, each casing section must be retrieved from its original location, typically on a rack beside the drilling platform, and be suspended above well center so that each casing section is in line with the casing section previously disposed within the wellbore. The threaded connection must be made up by a device that imparts torque to one casing section relative to the other, such as a power tong or a top drive. The casing string formed of the two casing sections is then lowered into the previously drilled wellbore.

Technology is available which allows communication in real time between the surface of the wellbore and within the wellbore while drilling with the drill string, often termed "measurements while drilling". One data transmission method from downhole to the surface while drilling with the drill string is mud pulsing, which involves digitally encoding data and transmitting the data to the surface as pressure pulses in the mud system. Communication between the surface and downhole permits sensing of conditions within the wellbore, such as pressure, formation, temperature, or drilling fluid parameters. By monitoring the conditions within the wellbore in real time while drilling with the drill string, conditions may be adjusted and optimized accordingly. The mud pulsing method of data transmission is disadvantageously slow and capable of transmitting little or no power or data.

Another method for data transmission in real time through drill pipe while drilling with the drill string involves drilling with wires or cables. Employing wires or cables which connect surface equipment and downhole equipment located within the wellbore allows operation of downhole equipment by sending signals or power from the surface to downhole equipment. Exemplary downhole equipment which may be advantageously operated from the surface includes a motor which provides torque to the drill string for drilling into the formation as well as float equipment. Furthermore, communication between the surface and downhole allows sensing of wellbore conditions, as delineated above. A sensor may be placed close to or within the drill bit at the end of the drill string to transmit data regarding conditions present in the wellbore to the surface equipment. The surface equipment then processes the signal into interpretable data.

It is common to employ more than one string of casing in a wellbore. In this respect, the well is drilled to a first designated depth with a drill bit on a drill string. The drill string is removed. Sections of casing are connected to one another and lowered into the wellbore using the pipe handling operation described above to form a first string of casing longitudinally fixed in the drilled out portion of the wellbore. While the above method of data and power transmission in real time while initially drilling with the drill string to drill a hole for the casing string is generally more effective than mud pulsing because it allows more power and data transmission in a faster period of time, the process of drilling into the formation with the drill string to a first depth to form a wellbore for a first casing string while sensing conditions in real time, then removing the drill string from the wellbore, then placing the first casing string within the wellbore, then drilling the wellbore to a second depth with the drill string, then removing the drill string, then placing the second casing string within the wellbore, and then repeating this process for subsequent casing string is time consuming and, thus, not cost effective.

It is often desirable to monitor conditions within the wellbore or to operate tools disposed on the casing string while lowering the first casing string and/or subsequent casing strings into the wellbore. To communicate from the surface to downhole, and vice versa, a first section of wire is often connected to downhole equipment, while a second section of wire is connected to surface equipment. The first section of wire is disposed on the first casing section of the first casing string, while the second section of wire is disposed on the second casing section of the first casing string. The wires must be aligned to provide a conductive path between the surface and downhole. The usual method to align the wires of casing sections involves timing threads, wherein the threads of each casing section are machined so that at a given torque, the wires are aligned. Timing marks are usually disposed on each casing section. When the timing marks are aligned, which may be visually ascertained, the wire sections are aligned to conduct through casing sections. Methods for clocking or timing threads are described in U.S. Pat. No. 5,233,742 entitled "Method and Apparatus for Controlling Tubular Connection Make-Up", issued on Aug. 10, 1993 to *Gray* et al., and in U.S. Pat. No. 4,962,579 entitled "Torque Position Make-Up of Tubular Connections", issued Oct. 16, 1990 to *Moyer* et al., which are both herein incorporated by reference in their entirety.

The next step in a typical drilling operation includes cementing the first string of casing into place within the wellbore by a cementing operation. Next, the well is drilled to a second designated depth through the first casing string, and a second, smaller diameter string of casing comprising casing sections is hung off of the first string of casing. A second cementing operation is performed to set the second string of casing within the wellbore. This process is typically repeated with additional casing strings until the well has been drilled to total depth. In this manner, wellbores are typically formed with two or more strings of casing.

After the two or more strings of casing are set within the wellbore, it is often desirable to monitor conditions within the wellbore during operations such as hydrocarbon production operations or treatment operations. It is also desirable to operate downhole tools such as packers and valves from the surface during downhole operations. One method of providing communication from the surface to downhole (and vice versa) involves running wire connected to downhole equipment at one end, such as a sensor or a downhole tool, and connected to surface equipment at the other end, such as a processing unit, into the wellbore after placing the casing string into the wellbore. Another method involves placing a section of wire on each casing string as it is lowered into the previously-drilled wellbore, then inductively coupling the wire from each casing string to the wire from the adjacent casing string. In this way, the casing strings may be inductively coupled end-to-end. A method and apparatus for inductively coupling casing strings is illustrated in U.S. Pat. No. 4,901,069 issued to *Veneruso* on Feb. 13, 1990, which is herein incorporated by reference in its entirety.

In the conventional well completion operations described above, wire is placed on the outside of a casing section as it is lowered into the drilled out portion of the formation. Running the wire on the outside of casing sections subjects the wire to damage and degradation due to wellbore fluids, which may be turbulent in flow and/or high in temperature within the wellbore.

As an alternative to the conventional drilling method, drilling with casing is a method often used to place casing strings within the wellbore. This method involves attaching an earth removal member typically in the form of a drill bit to the lower end of the same string of casing which will line the wellbore. Drilling with casing is often the preferred method of well completion because only one run-in of the working string into the wellbore is necessary to form and line the wellbore for each casing string.

Drilling with casing may be accomplished in at least two manners. In the first method, the first casing string inserted into the wellbore has an earth removal member operatively attached to its lower end. The first casing string may include one or more sections of casing threadedly connected to one another by the pipe handling operation described above. In a drilling with casing operation, the casing sections are threaded to one another using the top drive connected to a gripping head. The gripping head has a bore therethrough through which fluid may flow and grippingly engages the casing sections to serve as a load path to transmit the full torque applied from the top drive to the casing sections to make up the connection between casing sections. The gripping head is an external gripping device such as a torque head or an internal gripping device such as a spear. An exemplary torque head is described in U.S. Pat. No. 6,311,792 B1 issued to *Scott* et al. on Nov. 6, 2001, which is herein incorporated by reference in its entirety. An exemplary spear is described in U.S. Patent Application Publication No. US 2001/0042625 A1, filed by Appleton on Jul. 30, 2001, which is herein incorporated by reference in its entirety.

After the pipe handling operation is conducted to connect casing sections to form a casing string, the first casing string is lowered into the formation while the earth removal member rotates to drill the first casing string to a first depth. The first casing string is then secured above the formation by a gripping mechanism such as a spider, which comprises a bowl inserted in the rig floor and gripping members such as slips which are movable within the bowl along an inclined slope to grippingly engage the outer diameter of casing strings. The gripping head is released from engagement with the first casing string.

The gripping head then grippingly and sealingly engages a second casing string. The second casing string is threadedly connected to the first casing string by a pipe handling operation. The spider is released as the gripping head now suspends the two connected casing strings, and the earth removal member on the first casing string is rotated while the first and second casing strings, which are now connected and move together, are lowered to drill the first and second casing strings to a second depth within the formation. This process is repeated to drill subsequent casing strings to a further depth within the formation.

A second drilling with casing method involves drilling with concentric strings of casing. In this method, the first casing string is run into the wellbore with a first earth removal member operatively connected to its lower end. The first earth removal member rotates relative to the first casing string as the first casing string is simultaneously lowered into the formation to drill the first casing string to a first depth. The first casing string is set by setting fluid such as cement within the wellbore. Next, a second casing string, which is smaller in diameter than the first casing string, having a second earth removal member operatively connected to its lower end, drills through the cutting structure of the first casing string and to a second depth in the formation. The second earth removal member and the second casing string drill in the same way as the first casing string. The second casing string is set within the wellbore, and subsequent casing strings with earth removal members attached thereto are drilled into the formation in the same manner as the first and second casing strings.

During the drilling with casing operation, it is necessary to circulate drilling fluid while drilling the casing string into the formation to form a path within the formation through which the casing string may travel. Failure to circulate drilling fluid while running the casing string into the formation may cause the casing string to collapse due to high pressure within the wellbore; therefore, it is necessary for a fluid circulation path to exist through the casing string being drilled into the formation. A unique condition encountered while drilling with casing is plastering. Because the casing string is rotated so close to the formation, less fluid exists around the outside of the casing string while drilling.

In both drilling with casing methods described above, after the casing string is drilled to the desired depth within the formation, the casing string must often be cemented into the wellbore at a certain depth before an additional casing string is hung off of the casing string so that the formation does not collapse onto the casing string due to lack of support. Furthermore, the casing string must be cemented into the formation once it reaches a certain depth to restrict fluid movement between formations. To cement the casing string within the wellbore, a cementing tool including a cementing head is inserted into the casing string to inject cement and other fluids downhole and to release cement plugs.

While drilling with casing, it is desirable to monitor parameters within the wellbore in real time, as well as to operate downhole tools while drilling. It would be especially advantageous to sense the extent of plastering and hydrostatic conditions in real time while drilling with casing, as the solids content of the drilling fluid and other parameters of the fluid may be monitored and optimized while the casing string is drilling to facilitate drilling the casing string into the formation. It would be further advantageous to monitor downhole tools in real time, including cementing equipment and mud motors used to rotate the casing string while drilling.

To provide communication between the surface and downhole to monitor downhole conditions and operate downhole tools, the data communication must exist through a wire connecting the surface to downhole. Currently in drilling with casing operations, the wire is run into the wellbore after insertion of all of the desired casing strings within the wellbore. Downhole equipment is run into the wellbore with the casing string, and then, after the casing string is placed within the wellbore, a wire connected at one end to surface equipment is run into the wellbore and plugged into the downhole equipment. Running the wire into the casing string after drilling the casing string into the formation does not allow real time monitoring of the wellbore conditions during drilling.

Therefore, it is desirable to produce a wired casing string which is capable of transmitting electricity through the casing string across the threadable connections of individual casing joints. It is further desirable to produce a casing string which is capable of drilling into the formation as well as cementing the casing string into the formation through communication to the downhole equipment from the surface. It is even more desirable to place wire on the casing string while drilling with the casing string into the formation to allow real time monitoring of downhole conditions and operation of downhole tools while drilling with casing. It is further desirable to protect the wire from damage within the wellbore. It is even further desirable to protect the wire from damage within the wellbore across connections of sections of casing.

SUMMARY OF THE INVENTION

The present invention generally relates to lowering casing while simultaneously placing wire on the casing. In one aspect, the present invention involves lowering a first casing string with an earth removal member operatively connected to its lower end into an earth formation and placing wire on the first casing string while lowering the first casing string. A second casing string may be connected to the first casing string, then the first casing string lowered while placing wire on the second casing string.

Another aspect of the present invention involves a method of wiring casing while drilling with casing comprising lowering a first casing string with an earth removal member operatively connected to its lower end into an earth formation, placing a first wire on the first casing string while lowering the first casing string to a first depth within the formation, lowering a second casing string with an earth removal member operatively connected to its lower end into the formation, and placing a second wire on the second casing string while lowering the second casing string to a second depth within the formation. Yet another aspect of the present invention involves an apparatus comprising downhole equipment for sensing information from within the wellbore, surface equipment for processing the information, a wire for transmitting the information from the downhole equipment to the surface equipment, and a casing string with an earth removal member operatively connected to its lower end, wherein the casing string houses the wire.

Another aspect of the present invention includes an apparatus for use in transmitting signals from within a wellbore to a surface of the wellbore comprising downhole equipment for sensing information from within the wellbore, surface equipment for processing the information, a wire for transmitting the information from the downhole equipment to the surface equipment, and a first casing section comprising a groove therein for at least partially subflushing the wire to the surface of the first casing section. A method for monitoring conditions within a wellbore by wiring casing is also provided, comprising lowering a first casing section to a first depth within a formation and placing wire on the first casing section while lowering the first casing section, wherein the wire is at least partially sub-flushed to a surface of the first casing section.

Yet another aspect includes an apparatus for use in transmitting signals from within a wellbore to a surface of the wellbore, comprising downhole equipment for sensing information from within the wellbore, surface equipment for processing the information, a wire for transmitting the information from the downhole equipment to the surface equipment, a first tubular comprising a groove therein for at least partially subflushing the wire to a surface of the first tubular, and a second tubular comprising a groove therein for at least partially subflushing the wire to a surface of the second tubular, wherein the first tubular is connected to the second tubular and the wire is subflushed across the connection. Also included is a method for monitoring conditions within a wellbore while lowering tubulars into the wellbore, comprising lowering a first tubular into the wellbore, placing wire on the first tubular while lowering the first tubular, wherein the wire is at least partially sub-flushed to a surface of the first tubular, connecting the first tubular to a second tubular, lowering the second tubular into the wellbore, and placing wire on the second tubular while lowering the second tubular wherein the wire is at least partially subflushed to a surface of the second tubular, wherein the wire is subflushed across the connection of the first tubular to the second tubular.

In another aspect, embodiments of the present invention provide a method of drilling with casing, comprising providing a casing string having an earth removal member operatively attached to its lower end, the casing string having a first communication path within the inner diameter of the casing string and a second communication path for communicating power or signal through at least a portion of the casing string; and operating the earth removal member while lowering the casing string into a formation.

The method and apparatus of the present invention allow sensing and optimization of downhole conditions in real time while lowering casing, as well as operation of downhole tools in real time while drilling with casing. Moreover, placing wire on the casing string while lowering casing permits operation of automated devices downhole while the casing string is penetrating the formation as well as after the casing string is placed into the formation. The present invention further allows protection of wires while lowering the casing and after the casing is placed within the wellbore or drilled into the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1 is a sectional view of a first casing string connected to a first casing coupling being lowered into a hole in a rig floor at well center.

FIG. 2 is a section view of the first casing string and first casing coupling of FIG. 1.

FIG. 2A is a downward view of the first casing string along line 2A-2A of FIG. 1.

FIG. 2B is a downward view of the first casing string , wherein a tapered groove of the first casing string houses a wire therein.

FIG. 3 is a sectional view of the first casing string of FIG. 1. A wire connects downhole equipment located near an earth removal member of the first casing string to surface equipment located at the surface.

FIG. 11 is a sectional view of an alternate embodiment of the present invention. A wire is placed in a groove in a first casing string above a rig floor of a drilling rig.

FIG. 12 is a downward view of the first casing string of FIG. 11 disposed within a spider. A gap is disposed between gripping members of the spider to allow passage of the wire therethrough.

DETAILED DESCRIPTION OF THE PREFERRED EMBODIMENT

Figure 4:
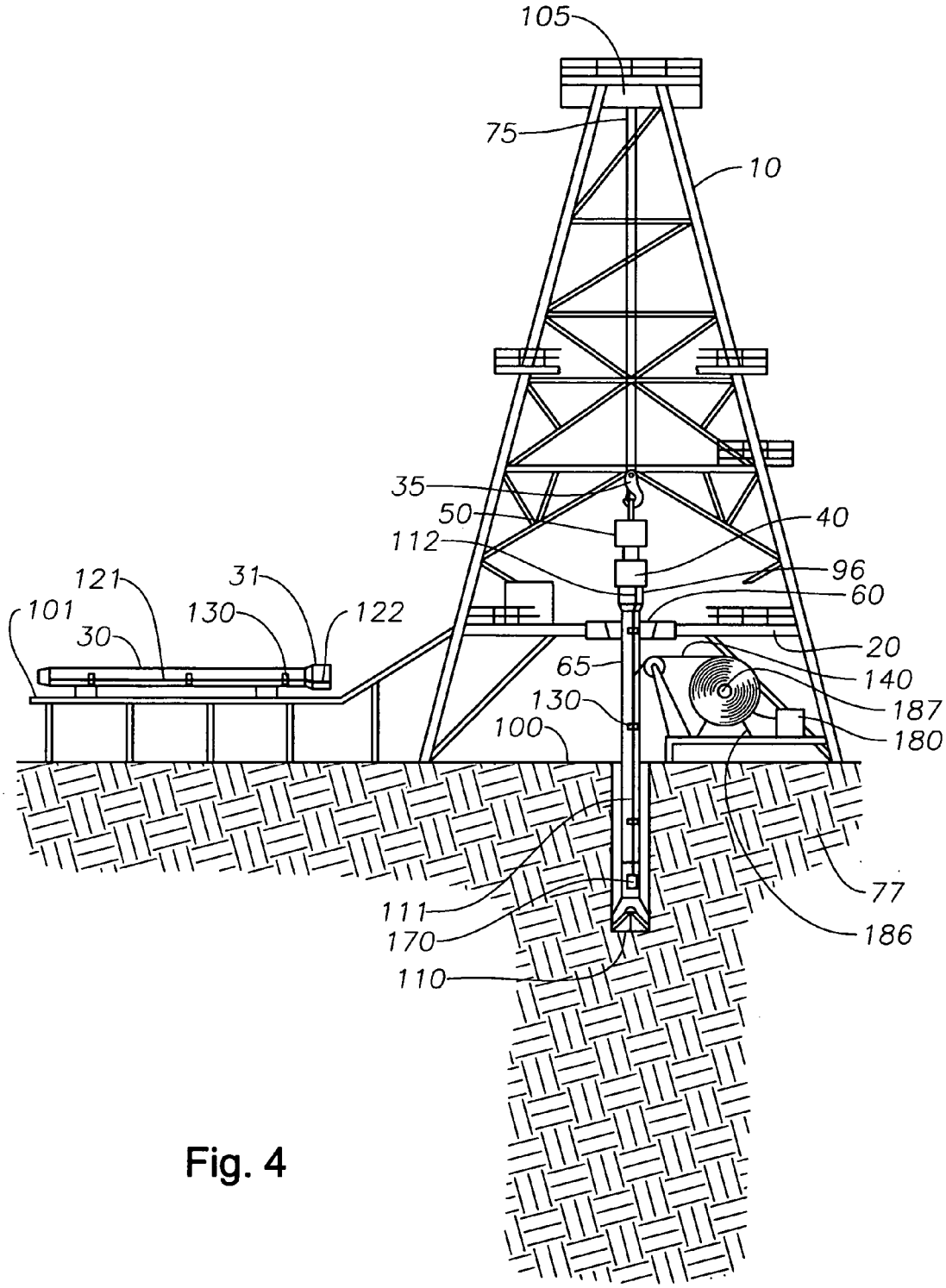
FIG. 4 is a sectional view of the first casing string of FIG. 1 drilling into a formation. The wire is located within a groove on the first casing string as the first casing string is drilled into the formation.

FIG. 1 shows a drilling rig 10 located above a surface 100 of a hydrocarbon-bearing formation 77. The drilling rig 10 supports a rig floor 20 above the surface 100. The rig floor 20 has a hole therethrough, the center longitudinal axis of which is termed well center. A spider 60 is disposed around or within the hole in the rig floor 20 to grippingly engage a first casing string 65, second casing string 30, and subsequent casing strings (represented by 15 of FIG. 5) at various stages of the operation. The spider 60 has gripping members such as slips (not shown) located therein to grippingly engage the casing strings 65, 30, and 15. A pipe handling arm (not shown) may extend from a side rail of the drilling rig 10 above the spider 60. The pipe handling arm is pivotable from a position perpendicular to the rig floor 20 when unactuated to a position parallel to the rig floor 20 when unactuated. Located on an end of the pipe handling arm closest to well center is a clamp (not shown) for engaging and guiding the casing strings 65, 30, and 15 at stages of the operation.

Connected to an upper portion of the drilling rig 10 is a draw works 105 with cables 75 which suspend a traveling block 35 above the rig floor 20. The traveling block 35 holds a top drive 50 above the rig floor 20. The top drive 50 includes a motor (not shown) which is used to rotate the casing strings 65, 30, 15 relative to the rig floor 20 at various stages of the operation while drilling with casing or while making up or breaking out a threadable connection between the casing strings 65 and 30 and/or casing strings 30 and 15. The top drive 50 is moveable co-axially with the well center along a railing system (not shown). The railing system prevents the top drive 50 from rotational movement during rotation of casing strings 65, 30, and 15, creating the necessary torque for the casing strings 65, 30, 15 but at the same time allowing for vertical movement of the top drive 50 under the traveling block 35.

A gripping head 40 is connected, preferably threadedly connected, to a lower end of the top drive 50. As shown in FIG. 1, the gripping head 40 is a torque head which employs gripping members such as slips (not shown) within its inner diameter to engage the outer diameter of the casing strings 65, 30, 15. The slips may be actuable by hydraulic force. It is understood that the gripping head 40 may also include a gripping mechanism which has gripping members disposed on its outer diameter to engage the inner diameter of the casing strings 65, 30, 15, such as a spear (not shown). FIG. 1 shows the gripping head 40 grippingly and sealingly engaging an end of a first casing coupling 96. The gripping members within the gripping head 40 move inward along the inner wall of the gripping head to grip the outer diameter of the first casing coupling 96. In the alternative, the gripping members may engage the outer diameter of the first casing string 65 below the first casing coupling 96.

The lower end of the first casing coupling 96 is threadedly connected to an upper end of the first casing string 65. The first casing coupling 96 is a hollow, tubular-shaped device with female threads located on each of its ends to connect the first casing string 65 to second casing string 30 because the first casing string 65 has male threads at an upper end, and the second casing string 30 has male threads at both ends. Typically, subsequent casing strings 15 have male threads at both ends; therefore, a second casing coupling 31 is threadedly connected to an end of the second casing string 30, and likewise for subsequent casing strings 15. The casing couplings 96, 31 may be threaded onto the casing strings 65, 30 on location at the drilling rig 10 or prior to transporting the casing string 65, 30 to the drilling rig 10.

The first casing string 65 may include one or more joints or sections of casing threadedly connected to one another by one or more casing couplings. At a lower end of the first casing string 65 is an earth removal member, which may include a cutting structure 110 as shown in FIG. 1, for example a drill bit, which is used to drill through the formation 77 to form a wellbore 115 (see FIG. 3). The cutting structure 110 is operatively connected to the lower end of the first casing string 65, so that the connection between the cutting structure 110 and the first casing string 65 may exist anywhere within the first casing string 65, but the lower portion of the cutting structure 110 protrudes below the first casing string 65. The cutting structure 110 is rotatable in relation to the first casing string 65, as the cutting structure 110 rotates (by power produced by a mud motor, for example) while the first casing string 65 is lowered, without rotation of the casing string 65, to drill into the formation 77.

The second casing string 30 is shown located on a rack 101 away from the rig floor 20. The second casing string 30, which may also include one or more joints or sections of casing threadedly connected to one another by one or more casing couplings, is threadedly connected to the second casing coupling 31 at an end. The second casing string 30 does not have an earth removal member or cutting structure connected to its other end. Subsequent casing strings (such as 15) are similar to the second casing string 30 and second casing coupling 31.

FIG. 2 depicts the second casing string 30 and the second casing coupling 31. The second casing string 30 has a longitudinal groove 121 disposed therein. Likewise, the second casing coupling 31 has a longitudinal groove 122 disposed therein. The grooves 121 and 122 may be sub-flushed to the surface of the second casing string 30 and second casing coupling 31, respectively. The second casing string 30 and the second casing coupling 31 are threadedly connected so that the grooves 121, 122 are aligned with one another to form a continuous groove along the length of the second casing string 30 and the second casing coupling 31. The grooves 121, 122 are designed to receive and house a wire 140 (describe below, see FIG. 1). The groove 122 of the second casing coupling 31 slopes upward from the groove 121 of the second casing string 30, as the second casing coupling 31 is necessarily larger in diameter than the second casing string 30 so that the male threads of the second casing string 30 may be housed within the female threads of the second casing coupling 31. Accordingly, the wire 140 (see FIG. 1) ramps upward from the second casing string 30 to the second casing coupling 31 when disposed within the grooves 121, 122. A subsequent casing string 15 for threadable connection to the second casing coupling 31 will possess a smaller outer diameter than the second casing coupling 31; therefore, the wire 140 will ramp downward along the slope of the groove in the subsequent casing string 15. The same pattern results for each subsequent casing string (not shown) and casing coupling (not shown).

Referring again to FIG. 1, the first casing string 65 has a longitudinal groove 111 disposed therein, and the first casing coupling 96 has a longitudinal groove 112 disposed therein. The longitudinal grooves 111, 112 are the same as the longitudinal grooves 121, 122 in every respect except at the lower end of the first casing string 65, as the cutting structure 110 is located at the lower end of the first casing string 65 rather than a male thread for receiving a casing coupling. The longitudinal grooves 111, 112 may be aligned with one another either before or after they are located at the drilling rig 10.

Downhole equipment 170 is shown located above the cutting structure 110 on the first casing string 65. In the alternative, the downhole equipment 170 may be located within the cutting structure 110 or within any downhole tool located on or in the first casing string 65. The downhole equipment 170 may include any equipment for receiving signals from the surface 100 of the wellbore 115 for controlling downhole tools including but not limited to cutting structures, cementing apparatus, valves, and packers. The downhole equipment 170 may be used to power and operate the downhole tools while drilling into the formation 77. The present invention may be utilized during a drilling with casing operation with the cementing apparatus and methods for cementing casing strings into the formation described in co-pending U.S. patent application Ser. No. 10/259,214 entitled "Smart Cementing Systems," filed on Sep. 27, 2002, which is herein incorporated by reference in its entirety.

Alternatively, the downhole equipment 170 may include devices for sensing and/or transmitting conditions within the wellbore 115. Downhole equipment 170 includes but is not limited to sensors which may be used with fiber optic cables. The downhole equipment 170 may be used to sense conditions in real time while drilling into the formation 77 with the first casing string 65. Specifically, the downhole equipment 170 may be utilized to sense plastering effects produced while drilling with casing.

FIG. 2A is a downward view along line 2A-2A of FIG. 1. In one embodiment, one or more wire clamps 130 are optionally disposed within or above the groove 111 and/or the groove 112 to hold the wire 140 within the grooves 111 and 112. FIG. 2A shows a wire clamp 130 disposed within the groove 111 of the first casing string 65. One or more wire clamps 130 may also optionally be located along the groove 121 and/or the groove 122 of the second casing string 30 and second casing coupling 31 to hold the wire 140 within the grooves 121 and 122 (see FIG. 7). Wire clamps 130 may be in the form of bands of metal, such as hose clamps, or of plug elastomers.

FIG. 2B shows an alternate embodiment of the groove 111 and/or groove 112. Instead of wire clamps 130, the upper ends 111B and 112B of sides 111A and 112A of the grooves 111 and 112 may be designed to protrude inward so that the distance between the sides 111A and 112A of the grooves 111 and 112 at the upper ends 111B and 112B (closest to the outer diameter of the casing string 65 or casing coupling 96) is smaller than the outer diameter of the wire 140. The ends 111C and 112C of the grooves 111 or 112 closer to the inner diameter of the casing string 65 or casing coupling 96 are larger than the upper ends 111B and 112B, so that the grooves 111 and 112 have a width large enough to fit the wire 140 therein. The sides 111A and 112A may be taped inward, as shown in FIG. 2B, from the ends 111C, 112C closest to the inner diameter to the ends 111B, 112B at the outer diameter of the casing string 65 or casing coupling 96. Thus, the wire 140 may be elastically compressed past the ends 111B and 112B into the grooves 111 and 112 and securely housed therein without the use of the wire clamp 130. Fast curing adhesives (not shown) may also be used to adhere the wire 140 to the grooves 111 and 112 as the wire 140 is placed within the grooves 111 and 112. The grooves 121 and 122 may be constructed in the same manner to avoid the use of clamps 130.

Surface equipment 180 is connected to an end of the wire 140. Surface equipment 180 includes but is not limited to a telemetry unit, processor, and/or display unit/user interface. The surface equipment 180 may perform the function of transmitting signals through the wire 140 to operate downhole tools or may receive and process or display downhole conditions through information gathered by downhole equipment 170 and ultimately transmitted through the wire 140 to the surface equipment 180.

The wire 140 is housed on a spool 183. The spool 183 is located below the rig floor 20 so that the wire 140 does not travel through the spider 60 while the wire 140 is dispensed from the spool 183, as the spider 60 has slip members which may damage the wire 140. As shown in FIG. 1, the spool 183 is located on the surface 100 of the formation 77, shown in FIG. 1 located on a rack 195. In the alternative, a second rig floor (not shown) may be built below the rig floor 20, and the wire 140 may be dispensed from the spool 183 placed on the second rig floor. The spool 183 has an axle 187 suspending the wire 140 above legs 186, while a dispensing unit 190 is used to dispense the wire 140 from the spool 183. The legs 186 remain stationary while the wire 140 is dispensed from around the axle 187, as described below. Slip rings (not shown), or circumferential conductive threads, may be used to conduct electricity through the spool 183 to the wire 140.

In the operation of the embodiments shown in FIGS. 1-7, the first casing string 65 is retrieved from the rack 101, a pickup/lay down machine (not shown), or another location away from well center. The first casing string 65 may be brought to well center from the rack 101 by an elevator (not shown), the gripping head 40, or any other gripping mechanism. The first casing string 65 with the first casing coupling 96 threadedly connected thereto is ultimately placed within the gripping head 40, and the gripping members of the gripping head 40 grippingly and sealingly engage the outer diameter of the first casing coupling 96 or the first casing string 65, as shown in FIG. 1. Alternatively, when internal gripping members are used, such as when using a spear as the gripping head 40, the gripping head 40 is placed inside the first casing string 65, and the gripping members grippingly and sealingly engage the inner diameter of the first casing string 65. In this position, fluid communication exists through a sealed path from the top drive 50 all the way down through the gripping head 40. The gripping head 40 also fixes the first casing string 65 longitudinally and rotationally with respect to the gripping head 40.

The pipe handling arm (not shown) is then pivoted out toward the first casing string 65 while the clamp (not shown) of the pipe handling arm is in an open position so that jaws (not shown) of the clamp are open. Once the clamp is positioned around the first casing string 65, the jaws of the clamp are closed around the first casing string 65. The first casing string 65 is moved downward toward the formation 77 by the cables 75 on the draw works 105.

Once the first casing string 65 is lowered to a location below the rig floor 20 but above the formation 77, the wire 140 is connected to the downhole equipment 170 so that signals may be sent and/or received through the wire 140 between the downhole equipment 170 and the surface equipment 180. As previously mentioned, the surface equipment 180 is connected to the opposite end of the wire 140 from the downhole equipment 170. FIG. 3 shows the end of the wire 140 connected to the downhole equipment 170.

Next, the wire 140 is placed within the groove 111 in the first casing string 65. The wire 140 may be secured within the groove 111 by the wire clamp 130, if one is provided within or on the groove 111. As the first casing string 65 is lowered further toward the formation 77, the wire 140 is continually threaded within the groove 111 so that the groove 111 houses the length of the wire 140 which is dispensed.

The cutting structure 110 of the first casing string 65 is then rotated, preferably by a mud motor, while the draw works 105 moves the first casing string 65 downward into the formation 77 to drill the first casing string 65 into the formation 77. The pipe handling arm aids in maintaining the first casing string 65 in line with well center to guide the first casing string 65 during the drilling operation. The cutting structure 110 drills into the formation 77 to form a wellbore 115. While drilling with the first casing string 65, drilling fluid under pressure is introduced into the assembly to prevent the inner diameter of the first casing string 65 from filling up with mud and other wellbore fluids, as well as to create a path for the first casing string 65 within the formation 77 while drilling. The sealable engagement of and the bores running through the top drive 50, gripping head 40, and the first casing string 65 allow fluid to circulate through the inner diameter of the first casing string 65, and up through an annular space between the first casing string 65 and the formation 77. As the first casing string 65 is drilled into the formation, the wire 140 is continually placed within the groove 111 in the first casing string 65 as the axle 187 of the spool 183 rotates to dispense the wire 140. The groove 111 serves as a housing to protect the wire 140 from wellbore fluids while the first casing string 65 is being drilled into the formation 77. FIG. 4 shows the first casing string 65 as it is being drilled into the formation 77 to form a wellbore 115.

Once the first casing string 65 is drilled to the desired depth within the formation 77, the spider 60 is actuated to grippingly engage the outer diameter of a portion of the first casing string 65. The gripping members (not shown) or slips of the spider 60 are engaged around the outer diameter of the casing string 65 to rotationally and axially fix the first casing string 65 relative to the rig floor 20. After the spider 60 is actuated to grip the first casing string 65, the gripping members of the gripping head 40 are released and the assembly is moved upward relative to the rig floor 20 and the first casing string 65 disposed therein. The pipe handling arm is then unactuated.

Figure 5:
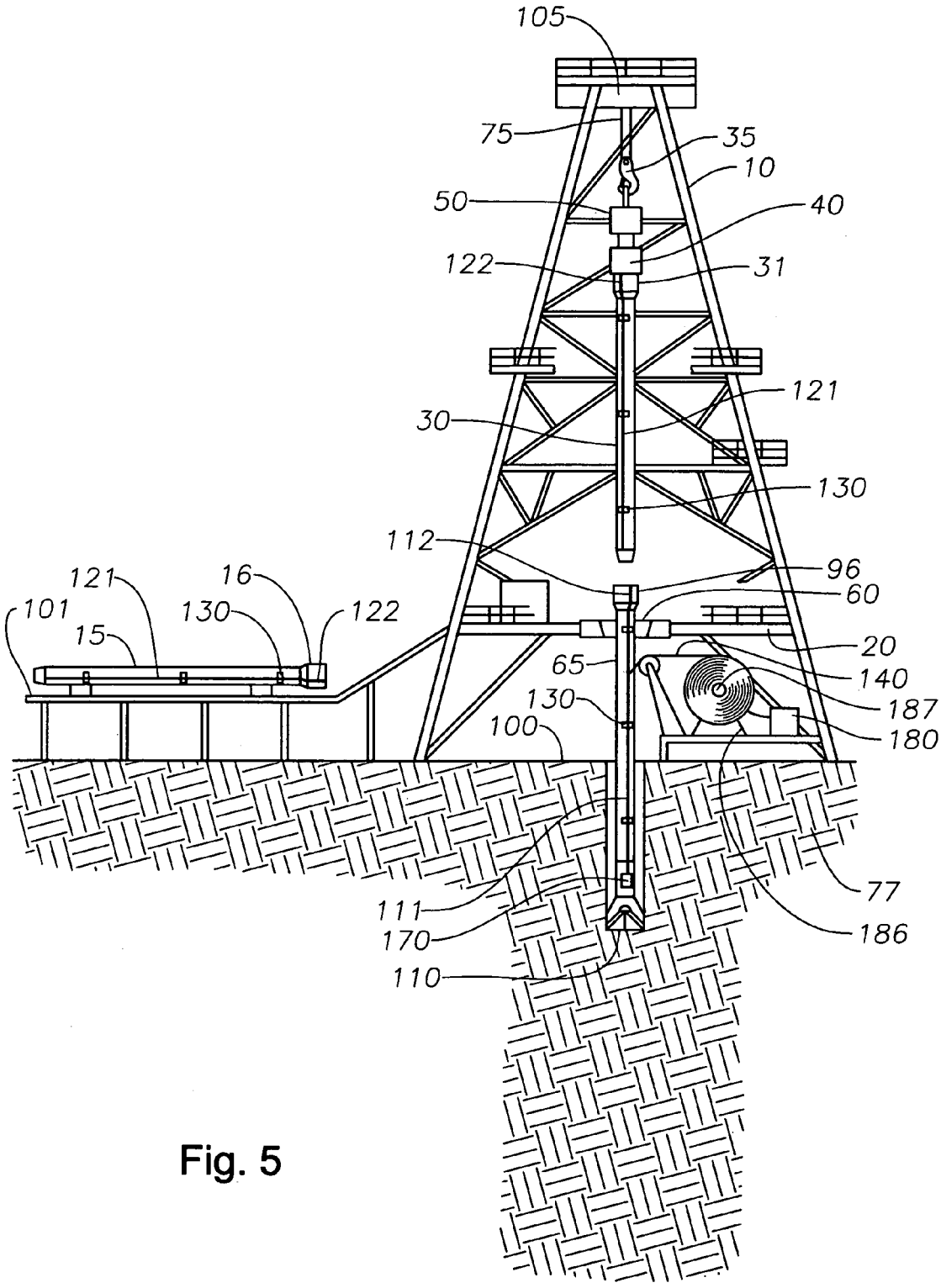
FIG. 5 is a sectional view of the first casing string drilled into the formation to a first depth and held by a spider. A second casing string is held above the first casing coupling by a gripping head.

In the next step of the operation, the second casing string 30 and the connected second casing coupling 31 are retrieved from the rack 20 and brought to well center. The gripping head 40 grippingly and sealingly engages the second casing string 30 or the second casing coupling 31 and suspends the second casing string 30 and second casing coupling 31 above the rig floor 20. FIG. 5 shows the first casing string 65 drilled into the formation to a first depth and the second casing string 30 and second casing coupling 31 suspended above the rig floor 20 at well center.

Next, the pipe handling arm is again actuated so that the clamp is placed around the second casing string 30. Now the pipe handling operation involving threading the second casing string 30 onto the first casing string 65 is ready to be conducted. The second casing string 30 is lowered toward the first casing coupling 96 so that the female threads of the first casing coupling 96 contact the male threads of the second casing string 30. The motor (not shown) of the top drive 50 rotates the gripping head 40 and, thus, the second casing string 30. The second casing string 30 along with the second casing coupling 31 rotate relative to the first casing string 65 and the first casing coupling 96, which both remain axially and rotationally fixed within the rig floor 20.

Figure 6:
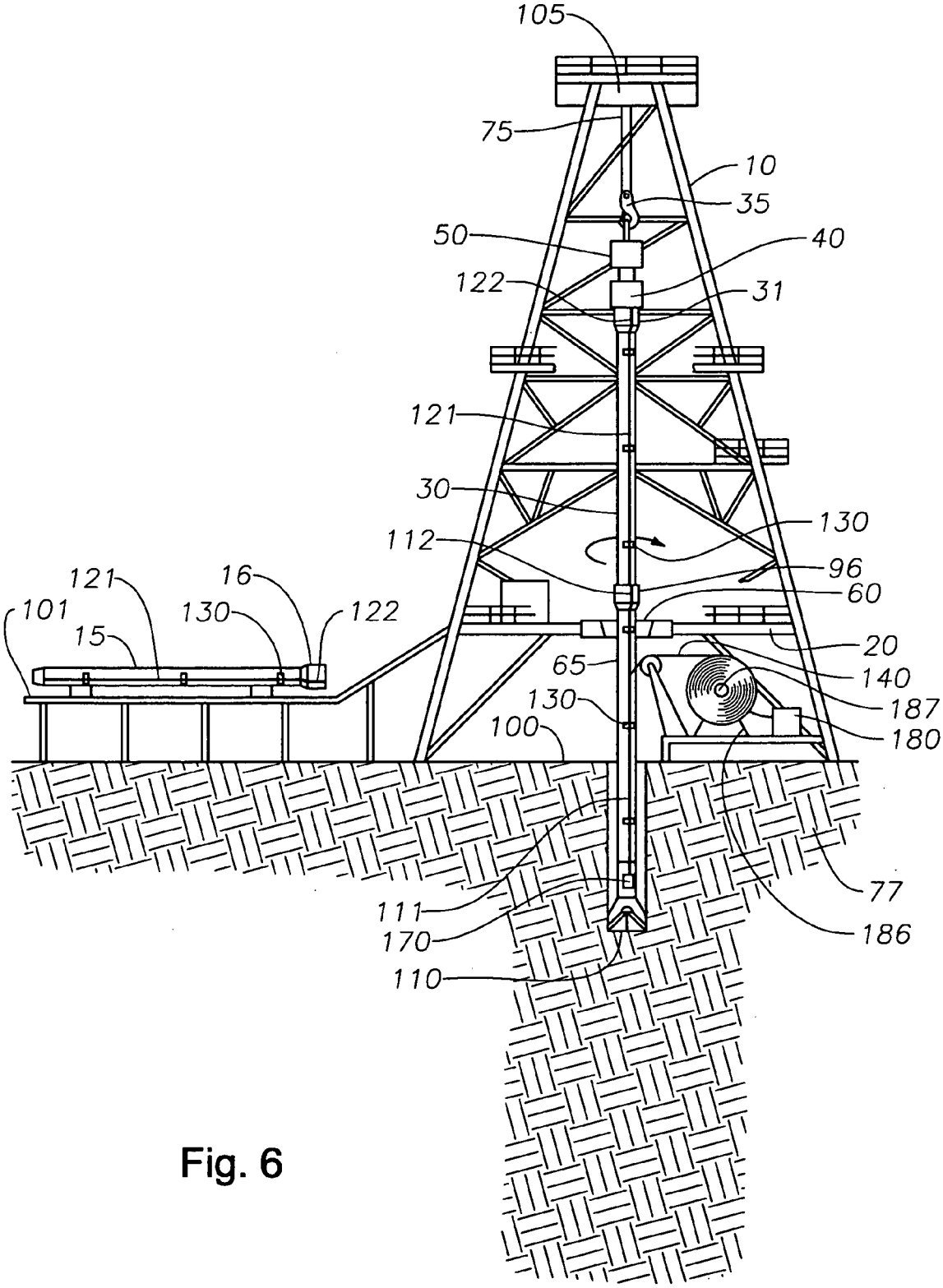
FIG. 6 is a sectional view of the second casing string threaded onto the first casing coupling. A groove of the first casing coupling is aligned with a groove on the second casing string by timing threads.

The second casing string 30 is rotated to thread onto the first casing string 65 so that the threaded connection is made up to connect the casing strings 65, 30. In making up the threadable connection, the groove 112 of the first casing coupling 96 must be aligned with the groove 121 of the second casing string 30 so that the wire 140 may be housed within a continuous groove formed by the aligned grooves 112, 111, 122, and 121. In aligning the grooves 112 and 121, timing marks may be utilized to clock or time the threads. Timing marks or hatch marks (not shown) are placed on the casing string 30 and casing couplings 96 to be made up so that whether the adjacent casing strings 30 and 65 are properly aligned may be determined by visual inspection. Once the timing marks are aligned with one another, rotation of the second casing string 30 is halted and the grooves 112 and 121 are aligned with one another. The threads of the casing strings 65 and 30 and couplings 96 and 31 (as well as subsequent casing strings) are calculated and machined, typically in the factory, so that the timing marks indicate the rotational synchronization of the grooves 112 and 121 at a certain torque. FIG. 6 shows the groove 112 matched with the groove 121 by timing of the threads.

Figure 7:
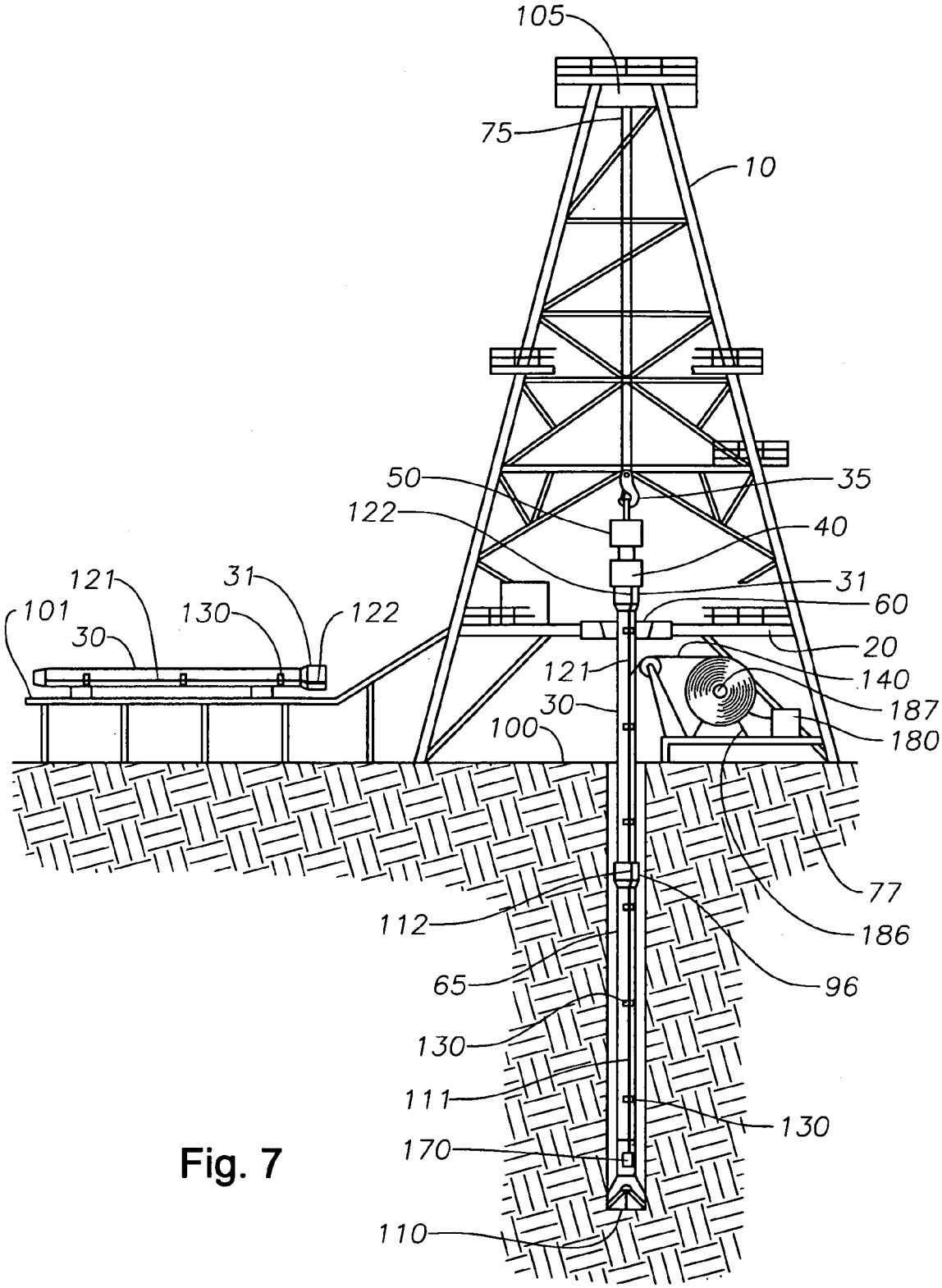
FIG. 7 is a sectional view of the second casing string and the first casing string being drilled into the formation to a second depth, while the wire is simultaneously dispensed into the groove of the second casing string.

After making up the threadable connection between the casing strings 30 and 65, the drilling with casing operation begins. The gripping members of the spider 60 are released so that the first casing string 65 is movable axially within the formation 77. At this point, the gripping head 40 suspends both of the casing strings 65 and 30 because the second casing string 30 is connected to the first casing string 65. The draw works 105 lowers the casing string 65, 30 into the formation 77 while the cutting structure 110 is again rotated to drill to a second depth within the formation 77. Simultaneously, drilling fluid is introduced into the top drive 50 to flow through the gripping head 40 and through the second casing string 30 and the first casing string 65, then up through the annular space between the casing string 65, 30 and the formation 77. Also simultaneously, the wire 140 is dispensed from the spool 183 and inserted within the remainder of the groove 111, within the groove 112, then within the groove 121 as the casing string 65, 30 continues downward while drilling into the formation 77. FIG. 7 shows the casing string 65, 30 drilled to a second depth within the formation 77 to form a wellbore 115 of a second depth. The gripping members of the spider 60 are then engaged to contact the outer diameter of the second casing string 30, the gripping head 40 is released from the second casing string 30, and the operation is repeated for subsequent casing strings (such as 15).

Because the wire 140 is threaded onto the casing string 65, 30 while the casing string 65, 30 is drilling into the formation, the downhole equipment 170 may be manipulated and operated in real time by signals sent from the surface equipment 180 through the wire 140. For example, the earth removal member, valves, and/or packers may be operated by use of the present invention. Similarly, the downhole equipment 170 may sense wellbore conditions including geophysical parameters in real time while drilling and send signals from downhole to the surface equipment 180 for processing. After sensing parameters while drilling, the drilling conditions may be varied and optimized accordingly. Conditions which may be advantageously monitored and/or optimized include but are not limited to downhole pressure, temperature, and plastering effects caused during the drilling with casing operation.

Figure 10:
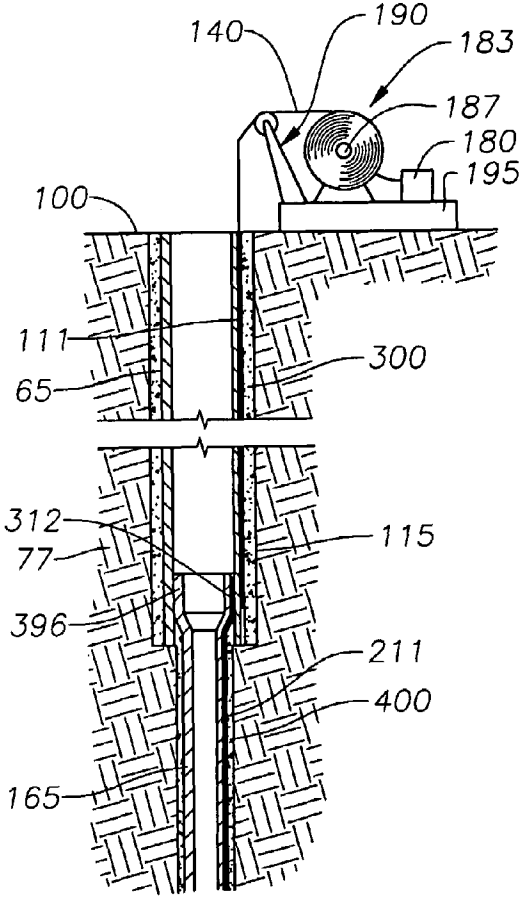
FIG. 10 is a cross-sectional view of the first casing string and second casing string of FIG. 9 set at a depth within the formation. The wires are inductively coupled to communicate from surface equipment to downhole equipment.
Figure 9:
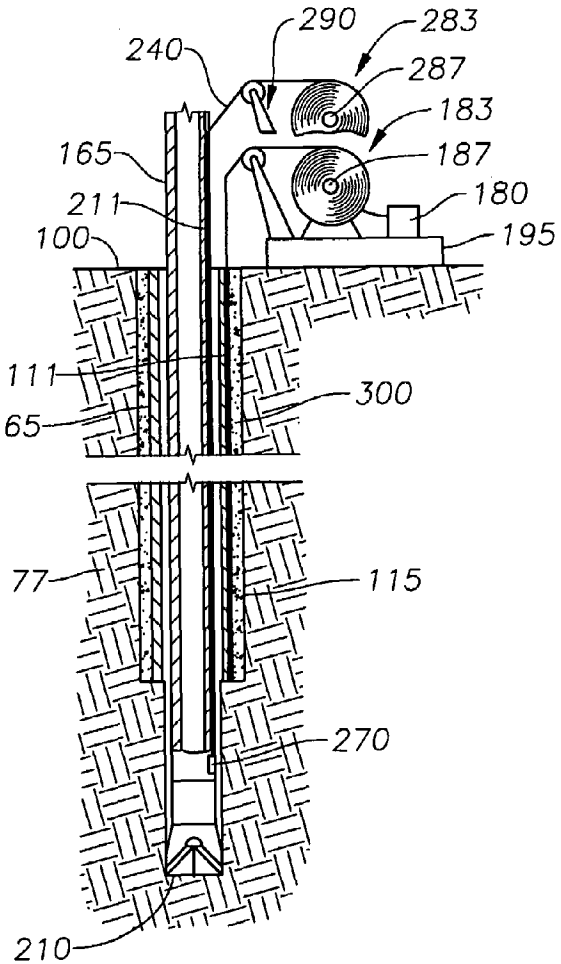
FIG. 9 is a cross-sectional view of the first casing string of FIG. 8, where the earth removal member of the first casing string is being drilled through by a second casing string with an earth removal member operatively attached to its lower end. The second casing string has wire located within a groove as the second casing string is drilled into the formation.
Figure 8:
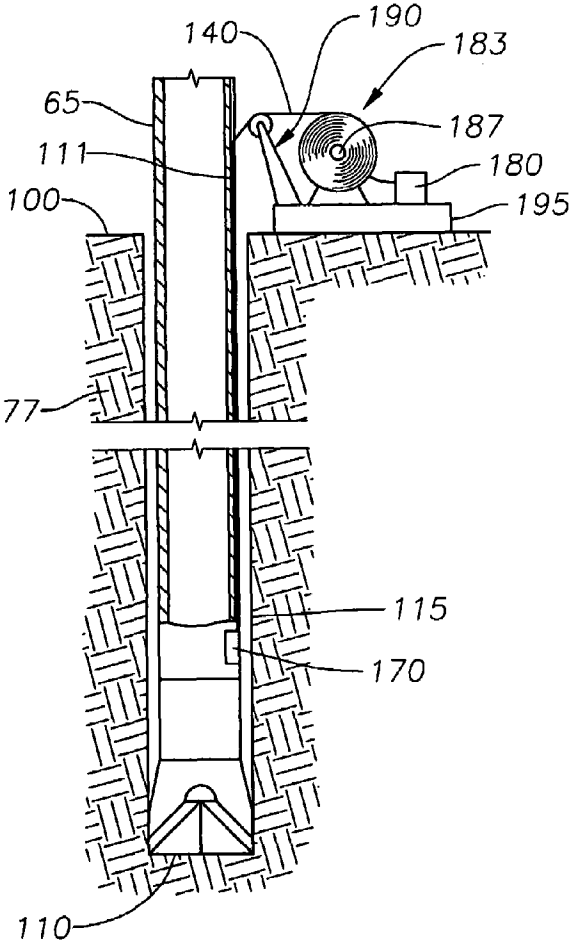
FIG. 8 is a cross-sectional view of an alternate embodiment of the present invention. A first casing string has an earth removal member operatively attached to its lower end and is being drilled into a formation. A wire connects downhole equipment located near an earth removal member of the first casing string to surface equipment. The wire is located within a groove on the first casing string as the first casing string is drilled into the formation.

FIGS. 8-10 depict an alternate embodiment of the present invention primarily for use while drilling with concentric strings of casing. Although not shown, the drilling rig 10 of FIGS. 1-7 with all of its component parts is located above the surface 100 in the embodiment of FIGS. 8-10. The same spool 183 with identical parts to the embodiment of FIGS. 1-7 dispenses the wire 140 into the groove 111 of the first casing string 65, as shown in FIGS. 8-10, in the same way as explained above in relation to FIGS. 1-7. As in FIGS. 1-7, the wire 140 is connected at one end to the surface equipment 180 and at the other end to downhole equipment 170. Also as in FIGS. 1-7, the first casing string 65 has a cutting structure 110 operatively connected to its lower end and powered by, for example, a mud motor. The first casing string 65 may optionally have a coupling (not shown) threadedly connected to its upper end. The casing string 65 may include one or more sections of casing threadedly connected by couplings.

FIGS. 9-10 show a second casing string 165 at various stages of drilling into the formation 77. The second casing string 165 may also optionally include one or more sections of casing threadedly connected by couplings. A coupling 396 is optionally threadedly connected to an upper end of the second casing string 165. The second casing string 165 has an earth removal member, preferably a cutting structure 210 such as a drill bit, operatively connected to its lower end and powered by another mud motor or other apparatus for providing torque to the cutting structure 210. The cutting structure 210 is used to drill through the cutting structure 110 of the first casing string 65 and through the portion of the formation 77 below the first casing string 65. Located on the second casing string 165 is downhole equipment 270, which is connected to a wire 240. The wire 240 is disposed within a groove 211 located within the second casing string 165, which is similar to the groove 111 of the first casing string 65. The coupling 396 of the second casing string 165 also has a groove 312 located therein for housing the wire 240. The wire 140 is dispensed from a spool 283 into the grooves 211 and 312 during the operation. The spool 283 has an axle 287 and dispensing apparatus 290 as described above in relation to FIGS. 1-7.

In the operation of the embodiment of FIGS. 8-10, the first casing string 65 is picked up from the rack 101 and moved to well center, and the gripping head 40 grippingly engages the first casing string 65. The wire 140 is connected to the downhole equipment 170 after the first casing string 65 is lowered by the cables 75 through the unactuated spider 60. The first casing string 65 is lowered while the cutting structure 110 is rotated in relation to the first casing string 65, and drilling fluid is simultaneously introduced through the top drive 50, gripping head 40, and first casing string 65. While drilling the first casing string 65 into the formation 77, the wire 140 is dispensed from the spool 183 into the groove 111 of the first casing string 65. As described above, the groove 111 may have a smaller inner diameter upper portion or may have clamps (not shown) which maintain the wire 140 within the groove 111. FIG. 8 shows the first casing string 65 being drilled into the formation 77 while simultaneously placing wire 140 within the groove 111.

As shown in FIG. 9, the first casing string 65 is drilled to a first depth and set within the wellbore 115 by setting fluid such as cement 300, which is cured to hydrostatic pressure. The second casing string 165 is then releasably engaged by a working string (not shown), which is grippingly and sealingly connected to the gripping head 40, and suspended above the first casing string 65 at well center. Next, the downhole equipment 270 of the second casing string 165 is connected to the wire 240. The second casing string 165 is lowered while simultaneously rotating the cutting structure 210 and circulating drilling fluid through the top drive 50, gripping head 40, working string, second casing string 165, and up through an annulus between the outer diameter of the second casing string 165 and the inner diameter of the first casing string 65. Wire 240 is simultaneously dispensed from the spool 283 and placed into the groove 211 of the second casing string 165, which may possess wire clamps (not shown) or a smaller upper portion, as described above in relation to the groove 111. When wire 240 is placed within the length of the groove 111, wire 240 is then placed into the groove 312 of the coupling 396. The cutting structure 210 drills through the cutting structure 110 of the first casing string 65, then to a second depth within the formation 77, as shown in FIG. 9.

When the cutting structure 210 is drilled to the desired second depth, the second casing string 165 is set within the formation 77, such as by curing cement 400 to hydrostatic pressure. The wire 240 is then coupled, preferably inductively coupled, to the wire 140 by any method known by those skilled in the art. When the wire 240 is coupled to the wire 140, information may be transferred to surface equipment 180 from downhole equipment 170, and to downhole equipment 170 from surface equipment 180. Further, downhole tools may be operated by signals sent to downhole equipment 170 from the surface 77. Subsequent casing strings (not shown) with earth removal members attached thereto and downhole equipment disposed thereon may be drilled into the formation in the same manner as described above while placing wire within a groove disposed within the casing strings. In this way, a cased wellbore may be formed of any desired depth within the formation.

An alternate embodiment of the present invention is shown in FIGS. 11-12. The parts of FIGS. 11-12 which are the same as the parts of FIGS. 1-7 are labeled with the same numbers. As shown in FIG. 11, the dispensing unit 190 is located above the rig floor 20. The wire 140 is run from the spool 183 through a hole 199 in the rig floor 20 and around the dispensing unit 190 for placement in the groove 111 of the first casing string 65. FIG. 12 illustrates the spider 60 usable with this embodiment. The spider 60 has gripping members 12 such as slips which grippingly engage the casing string 65 at various stages of the operation, as described above in relation to FIGS. 1-7. A gap 13 is disposed between the gripping members 12 so that the wire 140 may be run through the spider 60 without the gripping members 12 damaging the wire 140. The groove 111 is aligned with the gap 13 in the gripping members 12. Subsequent grooves 112, 121, and 122 are placed within the gap 13 in subsequent stages of the operation.

Figure 13:
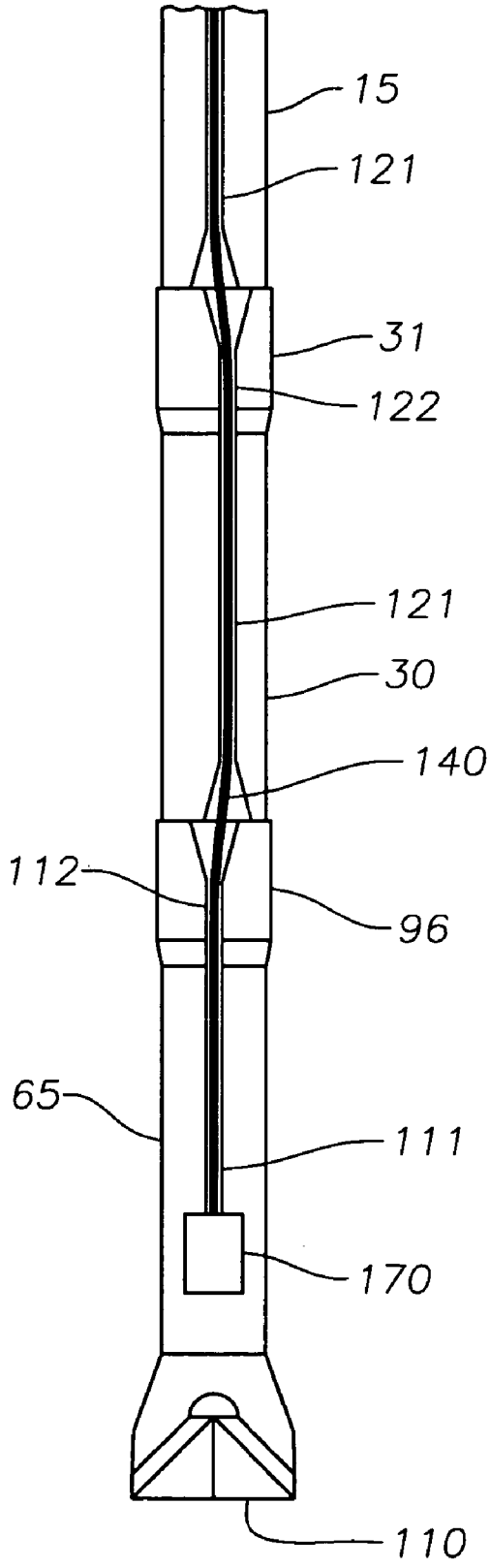
FIG. 13 shows an embodiment of grooves disposed on casing strings and casing couplings which may be used with any of the embodiments of the present invention.

In all of the above embodiments, as shown in FIG. 13, the lower ends of the grooves 111, 121 of the casing strings 65, 30, and 15 may be enlarged. Likewise, the upper ends of the grooves 112, 122 of the casing couplings 96, 31, and 16 may be enlarged. Enlarging the mating portions of the grooves 111, 121, 112, 122 allows the wire 140 to pass through the grooves 111, 121, 112, 122 even if the grooves 11, 112, 121, 122 are not exactly aligned. The grooves 111, 121, 112, 122 must only be substantially aligned.

The above embodiments of the invention are also contemplated to be utilized while drilling into the formation with the conventional completion method, namely drilling with a drill string into the formation to form a wellbore of a first depth, placing a first casing string into the wellbore of the first depth, then drilling to subsequent depths and placing subsequent casing strings within the wellbores of subsequent depths. The wire 140 is at least partially subflushed to the surface of the casing sections and couplings which make up a casing string by grooves formed in casing sections and couplings, as described above. The first casing string 65, in the conventional drilling method, would not possess an earth removal member at its lower end; rather, the first casing string 65 would be similar to the second casing string 30. The wire 140 is placed within the grooves of casing sections as described above while lowering the casing string 65 (and subsequently casing string 30) into the previously drilled wellbore. The method of timing threads, as described above, may be utilized to align the adjacent grooves of the casing couplings and casing sections so that the wire 140 is subflushed to the surface of the casing couplings and casing sections across threaded connections. It is also contemplated that any type of tubular body, not merely casing strings, may be utilized to at least partially subflush and protect the wire 140 across connections of tubulars.

In all of the embodiments of the present invention shown and described above, the wire 140 may include an electrical, fiber optic, and/or hydraulic line. The electrical, fiber optic, and/or hydraulic line may be used to operate any appropriate downhole equipment or to convey downhole conditions to the surface of the wellbore. Additionally, embodiments of the present invention do not require placing the wire 140 on the casing while running the casing into the formation; rather, it is within the scope of embodiments of the present invention for the wire 140 to be placed on the casing which is being drilled prior to lowering the casing into the formation to form a wellbore or after the casing is placed within the wellbore.

In one aspect, embodiments of the present invention include a method of drilling with casing, comprising providing a string of wired casing having an earth removal member operatively attached to its lower end, at least a portion of the string of wired casing having a conductive path therethrough; and operating the earth removal member while lowering the string of wired casing into a formation. In one embodiment, operating the earth removal member while lowering the string of wired casing into the wellbore comprises drilling with the string of wired casing into a formation. In another aspect, embodiments of the present invention include a method of drilling with casing, comprising providing a string of wired casing having an earth removal member operatively attached to its lower end, at least a portion of the string of wired casing having a conductive path therethrough; and operating the earth removal member while lowering the string of wired casing into a formation, wherein the conductive path is at least partially sub-flushed to a surface of the string of wired casing.

In another aspect, embodiments of the present invention include a method of drilling with casing, comprising providing a string of wired casing having an earth removal member operatively attached to its lower end, at least a portion of the string of wired casing having a conductive path therethrough; and operating the earth removal member while lowering the string of wired casing into a formation, wherein forming the string of wired casing comprises connecting a first casing section to a second casing section to form a conductive path through the casing sections. In one aspect, connecting the first casing section to the second casing section comprises substantially aligning a groove in the first casing section to a groove in the second casing section, the grooves having conductive paths therein. In another aspect, connecting the first casing section to the second casing section comprises substantially aligning a groove in the first casing section to a groove in the second casing section, the grooves having conductive paths therein and substantially aligning the grooves comprises substantially aligning an enlarged portion of the groove in the first casing section with an enlarged portion of the groove in the second casing section. In yet another aspect, connecting the first casing section to the second casing section comprises substantially aligning a groove in the first casing section to a groove in the second casing section, the grooves having conductive paths therein; substantially aligning the grooves comprises substantially aligning an enlarged portion of the groove in the first casing section with an enlarged portion of the groove in the second casing section; and substantially aligning the grooves further comprises substantially aligning corresponding timing marks in the first and second casing sections, the timing marks pre-machined to substantially align at a predetermined torque of the first casing section relative to the second casing section.

Embodiments of the present invention further include a method of drilling with casing, comprising providing a string of wired casing having an earth removal member operatively attached to its lower end, at least a portion of the string of wired casing having a conductive path therethrough; operating the earth removal member while lowering the string of wired casing into a formation; and sending a geophysical parameter through the conductive path. In one aspect, the method further comprises sending a signal through the conductive path.

Embodiments of the present invention further include a method of drilling with casing, comprising providing a string of wired casing having an earth removal member operatively attached to its lower end, at least a portion of the string of wired casing having a conductive path therethrough; and operating the earth removal member while lowering the string of wired casing into a formation, wherein the conductive path is formed by inductively coupling a first conductive path through the first casing section to a second conductive path through the second casing section.

Embodiments of the present invention further provide an apparatus for transmitting one or more signals through a wellbore, comprising a string of wired casing having a conductive path through at least a portion thereof; and an earth removal member operatively attached to a lower end of the string of wired casing, wherein the string of wired casing is disposed within the wellbore. In one aspect, the conductive path runs therethrough at least partially within a surface of the string of wired casing.

Embodiments of the present invention include an apparatus for transmitting one or more signals through a wellbore, comprising a string of wired casing having a conductive path through at least a portion thereof; and an earth removal member operatively attached to a lower end of the string of wired casing, wherein the string of wired casing is disposed within the wellbore and the string of wired casing comprises a first casing section connected to a second casing section and wherein the conductive path is continuous through the first and second casing sections. In one aspect, the first casing section and the second casing section comprise grooves therein for at least partially sub-flushing the conductive path into a surface of the string of wired casing. In another aspect, the conductive path may optionally be continuously sub-flushed across the connected first and second casing sections. In another aspect, the first casing section may further optionally comprise an enlarged portion of the groove at an end and the second casing section may comprise an enlarged portion of the groove at an end, wherein the ends of the casing sections are connected.

Embodiments of the present invention further provide an apparatus for transmitting one or more signals through a wellbore, comprising a string of wired casing having a conductive path through at least a portion thereof; and an earth removal member operatively attached to a lower end of the string of wired casing, wherein the string of wired casing is disposed within the wellbore, wherein the string of wired casing comprises a first casing section connected to a second casing section and wherein the conductive path is continuous through the first and second casing sections, and wherein a casing coupling connects the first and second casing sections, and wherein the conductive path is continuous through the casing coupling. In one aspect, the conductive path is at least partially sub-flushed to the surface continuously across the casing sections and the casing coupling.

Embodiments of the present invention further provide an apparatus for transmitting one or more signals through a wellbore, comprising a string of wired casing having a conductive path through at least a portion thereof; and an earth removal member operatively attached to a lower end of the string of wired casing, wherein the string of wired casing is disposed within the wellbore, wherein the string of wired casing comprises a first casing section connected to a second casing section and wherein the conductive path is continuous through the first and second casing sections, and wherein a casing coupling connects the first and second casing sections, and wherein the conductive path is continuous through the casing coupling, wherein the conductive path is housed in a continuous groove formed within the first and second casing sections and the casing coupling. In one aspect, the continuous groove is enlarged at the connection of the casing coupling and the second casing section.

While the foregoing is directed to embodiments of the present invention, other and further embodiments of the invention may be devised without departing from the basic scope thereof, and the scope thereof is determined by the claims that follow.

The invention claimed is:

1. A method of wiring casing while drilling with casing, comprising:

lowering a first casing string with an earth removal member operatively connected to its lower end into an earth formation;

placing wire on the first casing string while lowering the first casing string, thereby creating a wired casing string, wherein the wired casing string includes a conductive path that is at least partially sub-flushed across a connection between a casing section and a coupling;

connecting a second casing string to the first casing string, wherein connecting the second casing string to the first casing string comprises substantially aligning a groove in the second casing string with a groove in the first casing string such that an enlarged portion of the groove in the first casing string is substantially aligned with an enlarged portion of the groove in the second casing string;

lowering the first casing string into the earth formation; and placing the wire on the second casing string while lowering the first casing string.

2. The method of claim 1, wherein the wire is at least partially sub-flushed to a surface of the first casing string.

3. The method of claim 1, wherein the wire electrically connects surface equipment to downhole equipment.

4. The method of claim 1, wherein the wire is sub-flushed to a surface of the first casing string and the second casing string.

5. The method of claim 1, wherein substantially aligning the groove in the second casing string with the groove in the first casing string comprises substantially aligning timing marks.

6. The method of claim 5, wherein the first casing string and second casing string are pre-machined to substantially align the timing marks at a predetermined torque.

7. The method of claim 1, wherein placing wire on the first casing string comprises dispensing the wire from a spool located below a rig floor while lowering the first casing string.

8. The method of claim 1, wherein the wire is placed on the first casing string above the rig floor.

9. The method of claim 1, further comprising monitoring conditions within the earth formation through the wire while lowering the first casing string.

10. The method of claim 1, further comprising manipulating one or more downhole tools through the wire while lowering the first casing string.

11. The method of claim 1, further comprising using the wire to sense a geophysical parameter while lowering the first casing string.

12. The method of claim 1, wherein a sensing device is located at a lower end of the wire.

13. The method of claim 1, further comprising:

lowering the first casing string to a first depth within the earth formation; and operating one or more downhole tools through signals sent through the wire.

14. The method of claim 13, wherein the one or more downhole tools comprises a cementing apparatus.

15. The method of claim 13, wherein the one or more downhole tools comprises one or more packers.

16. The method of claim 13, wherein the one or more downhole tools comprises one or more valves.

17. A method of wiring casing while drilling with casing, comprising:

lowering a first casing string with an earth removal member operatively connected to its lower end into an earth formation;

placing a first wire on the first casing string thereby creating a first wired casing string while lowering the first casing string to a first depth within the formation, wherein the first wired casing string includes a conductive path that is at least partially sub-flushed across a connection between a casing section and a coupling;

lowering a second casing string with an earth removal member operatively connected to its lower end into the formation; and placing a second wire on the second casing string while lowering the second casing string to a second depth within the formation.

18. The method of claim 17, further comprising inductively coupling the first wire to the second wire.

19. The method of claim 18, wherein the wire is substantially sub-flushed to a surface of the first casing string.

20. The method of claim 18, wherein the first wire and the second wire electrically connect surface equipment to downhole equipment.

21. The method of claim 20, wherein surface equipment is connected to the first wire and downhole equipment is connected to the second wire.

22. The method of claim 17, wherein the first wire is dispensed from a first spool and the second wire is dispensed from a second spool.

23. A method for monitoring conditions within a wellbore by wiring casing, comprising:

lowering a first casing section to a first depth within a formation; and placing wire on the first casing section while lowering the first casing section, wherein the wire is at least partially sub-flushed to a surface of the first casing section and across a connection between a casing section and a coupling.

24. The method of claim 23, wherein the wire electrically connects surface equipment to downhole equipment.

25. The method of claim 23, further comprising:

connecting the first casing section to a second casing section;

lowering a second casing section to a second depth within the formation; and placing the wire on the second casing section while lowering the second casing section, wherein the wire is at least partially sub-flushed to a surface of the second casing section.

26. The method of claim 25, wherein the wire is continuous across the connection of the first casing section to the second casing section.

27. The method of claim 25, wherein the wire is continuously sub-flushed across the connection of the first casing section to the second casing section.

28. An apparatus for use in transmitting signals from within a wellbore to a surface of the wellbore, comprising:

downhole equipment for sensing information from within the wellbore;

surface equipment for processing the information;

a wire for transmitting the information from the downhole equipment to the surface equipment;

a first tubular comprising a groove therein for at least partially subflushing the wire to a surface of the first tubular; and a second tubular comprising a groove therein for at least partially subflushing the wire to a surface of the second tubular, wherein the first tubular is connected to the second tubular via a coupling and a conductive path is formed between the tubulars, the conductive path is at least partially sub-flushed across the coupling between the tubulars.

29. A method for monitoring conditions within a wellbore while lowering tubulars into the wellbore, comprising:

lowering a first tubular into the wellbore;

placing wire on the first tubular while lowering the first tubular, wherein the wire is at least partially sub-flushed to a surface of the first tubular;

connecting the first tubular to a second tubular via a coupling;

lowering the second tubular into the wellbore; and placing wire on the second tubular while lowering the second tubular, wherein the wire is at least partially sub-flushed to a surface of the second tubular, wherein a conductive path is formed between the tubulars and the conductive path is at least partially sub-flushed across the coupling between the first tubular to the second tubular.

30. A method of drilling with casing, comprising:

providing a string of wired casing having an earth removal member operatively attached to its lower end, at least a portion of the string of wired casing having a conductive path therethrough, wherein the conductive path is at least partially sub-flushed across a connection between a casing section and a coupling; and operating the earth removal member while lowering the string of wired casing into a formation.

31. The method of claim 30, wherein operating the earth removal member while lowering the string of wired casing into the wellbore comprises drilling with the string of wired casing into a formation.

32. The method of claim 30, wherein the conductive path is at least partially sub-flushed to a surface of the string of wired casing.

33. The method of claim 30, wherein forming the string of wired casing comprises connecting a first casing section to a second casing section to form a conductive path through the casing sections.

34. The method of claim 33, wherein connecting the first casing section to the second casing section comprises substantially aligning a groove in the first casing section to a groove in the second casing section, the grooves having conductive paths therein.

35. The method of claim 34, wherein substantially aligning the grooves comprises substantially aligning an enlarged portion of the groove in the first casing section with an enlarged portion of the groove in the second casing section.

36. The method of claim 35, wherein substantially aligning the grooves comprises substantially aligning corresponding timing marks in the first and second casing sections, the timing marks pre-machined to substantially align at a predetermined torque of the first casing section relative to the second casing section.

37. The method of claim 30, further comprising sending a geophysical parameter through the conductive path.

38. The method of claim 30, further comprising sending a signal through the conductive path.

39. The method of claim 30, wherein the conductive path is formed by inductively coupling a first conductive path through the first casing section to a second conductive path through the second casing section.

40. An apparatus for transmitting one or more signals through a wellbore, comprising:

a string of wired casing having a conductive path through at least a portion thereof, wherein the conductive path is at least partially sub-flushed across a connection between a casing section and a coupling, wherein the string of wired casing comprises a first casing section connected to a second casing section via the coupling and wherein the conductive path is continuous through the first and second casing sections and the coupling and wherein the conductive oath is housed in a continuous groove formed within the first and second casing sections and the coupling and wherein the continuous groove is enlarged at the connection of the coupling and the second casing section; and an earth removal member operatively attached to a lower end of the string of wired casing, wherein the string of wired casing is disposed within the wellbore.

41. The apparatus of claim 40, wherein the conductive path runs therethrough at least partially within a surface of the string of wired casing.

42. The apparatus of claim 40, wherein the conductive path is at least partially sub-flushed to the surface continuously across the casing sections and the casing coupling.

43. An apparatus for use in transmitting signals from within a wellbore to a surface of the wellbore, comprising:

downhole equipment for sensing information from within the wellbore;

surface equipment for processing the information;

a wire for transmitting the information from the downhole equipment to the surface equipment, wherein the wire is housed in a continuous groove formed within the first casing string and the first casing coupling and the continuous groove comprises an enlarged groove portion of the first casing string substantially aligned with an enlarged groove portion of a first casing coupling; and a first casing string with an earth removal member operatively connected to its lower end, wherein the first casing string houses the wire.

44. The apparatus of claim 43, wherein the downhole equipment comprises a sensor.

45. The apparatus of claim 43, wherein the surface equipment comprises a processing unit.

46. The apparatus of claim 43, wherein the first casing coupling connected to an upper end of the first casing string and the first casing coupling houses a portion of the wire above the first casing string.

47. An apparatus for use in transmitting signals from within a wellbore to a surface of the wellbore, comprising:

downhole equipment for sensing information from within the wellbore;

surface equipment for processing the information;

a wire for transmitting the information from the downhole equipment to the surface equipment;

a first casing section comprising a groove therein for at least partially sub-flushing the wire to the surface of the first casing section; and a second casing section comprising a groove therein for at least partially sub-flushing the wire to the surface of the second casing section, wherein the second casing section is connected to the first casing section and the wire is continuously sub-flushed across the connection of the first casing section to the second casing section, whereby the groove of the first casing section comprises an enlarged portion which connects to an enlarged portion of the groove of the second casing section.

48. The apparatus of claim 47, wherein the wire is continuously sub-flushed across the connection of the first casing section to the second casing section.

49. A method of drilling with casing, comprising:

providing a string of wired casing having an earth removal member operatively attached to its lower end, at least a portion of the string of wired casing having a conductive path therethrough, wherein forming the string of wired casing comprises connecting a first casing section to a second casing section by substantially aligning a groove in the first casing section to a groove in the second casing section, the grooves have conductive paths therein, whereby substantially aligning the grooves comprises substantially aligning an enlarged portion of the groove in the first casing section with an enlarged portion of the groove in the second casing section; and operating the earth removal member while lowering the string of wired casing into a formation.

50. The method of claim 49, wherein operating the earth removal member while lowering the string of wired casing into the wellbore comprises drilling with the string of wired casing into a formation.

51. The method of claim 49, wherein the conductive path is at least partially sub-flushed to a surface of the string of wired casing.

52. The method of claim 49, wherein substantially aligning the grooves comprises substantially aligning corresponding timing marks in the first and second casing sections, the timing marks pre-machined to substantially align at a predetermined torque of the first casing section relative to the second casing section.

53. The method of claim 49, further comprising sending a geophysical parameter through the conductive path.

54. The method of claim 49, further comprising sending a signal through the conductive path.

55. The method of claim 49, wherein the conductive path is formed by inductively coupling a first conductive path through the first casing section to a second conductive path through the second casing section.

56. An apparatus for use in transmitting signals from within a wellbore to a surface of the wellbore, comprising:

at least one sensor member for sensing information from within the wellbore;

a wire for transmitting the information from the sensor member to the surface;

a first casing section comprising a groove therein;

a second casing section comprising a groove therein, wherein the groove of the first casing section comprises an enlarged portion which at least partially overlaps with an enlarged portion of the groove of the second casing section upon connection of the casing sections, whereby the wire is disposable in the grooves.

57. An apparatus for transmitting one or more signals through a wellbore, comprising:

a string of wired casing having a conductive path through at least a portion thereof, wherein the conductive path is at least partially sub-flushed across a connection between a casing section and a coupling wherein the string of wired casing comprises a first casing section connected to a second casing section and wherein the conductive path is continuous through the first and second casing sections wherein the first casing section and the second casing section comprise grooves therein for at least partially sub-flushing the conductive path into a surface of the string of wired casing, wherein the conductive path is continuously sub-flushed across the connected first and second casing sections, wherein the first casing section comprises an enlarged portion of the groove at an end and the second casing section comprises an enlarged portion of the groove at an end, and wherein the ends of the casing sections are connected; and an earth removal member operatively attached to a lower end of the string of wired casing, wherein the string of wired casing is disposed within the wellbore.

* * * * *